US007769314B2

(12) United States Patent
Takayama

(10) Patent No.: US 7,769,314 B2
(45) Date of Patent: Aug. 3, 2010

(54) CLEANING DEVICE AND CHARGING DEVICE, IMAGE HOLDING UNIT AND IMAGE FORMING APPARATUS USING SAME

(75) Inventor: Yasuo Takayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 527 days.

(21) Appl. No.: 11/889,634

(22) Filed: Aug. 15, 2007

(65) Prior Publication Data

US 2008/0199207 A1 Aug. 21, 2008

(30) Foreign Application Priority Data

Feb. 20, 2007 (JP) ..... P2007-039769

(51) Int. Cl.
*G03G 15/02* (2006.01)
*A46B 15/00* (2006.01)

(52) U.S. Cl. ..... 399/100; 15/256.6

(58) Field of Classification Search ..... 399/100, 399/170–173; 15/256.6; 361/229–231
See application file for complete search history.

(56) References Cited

U.S. PATENT DOCUMENTS 4,885,466 A 12/1989 Koichi et al. ..... 250/324
5,012,093 A 4/1991 Shimizu ..... 250/324
5,182,694 A 1/1993 Endo ..... 361/229
5,687,054 A * 11/1997 Takada et al. ..... 361/225
6,163,664 A * 12/2000 Hayashi ..... 399/100
6,819,893 B2 * 11/2004 Kikuchi ..... 399/100
2004/0013443 A1 * 1/2004 Itoh et al. ..... 399/100

FOREIGN PATENT DOCUMENTS

JP A-06-043735 2/1994
JP A-08-305135 11/1996
JP A-2005-107236 4/2005

* cited by examiner

*Primary Examiner*—David M Gray
*Assistant Examiner*—Rodney Bonnette
(74) *Attorney, Agent, or Firm*—Morgan, Lewis & Bockius LLP

(57) ABSTRACT

A cleaning device is provided and includes: three or more cleaning members for cleaning a wire member, the three or more cleaning members being separately disposed along a longitudinal direction of the wire member and including a pair of side cleaning members and an intermediate cleaning member, the intermediate cleaning member being disposed opposite to the pair of side cleaning members with respect to the wire member and disposed between the side cleaning members in the longitudinal direction of the wire member; a mechanism that moves at least one of the cleaning members so as to contact all of the cleaning members with the wire member or separate all of the cleaning members from the wire member; and a mechanism that moves all of the cleaning members along the longitudinal direction of the wire member in a state where all of the cleaning members are contacted with the wire member.

16 Claims, 25 Drawing Sheets

GOING PATH

COMING PATH

FIG. 25

| DISCHARGE WIRE DIAMETER (μm) | CLEANING PAD BITING DISTANCE (mm) | TEAR OF CLEANING PAD (NO TEAR: O, TEAR: X) | | | | | | |
|---|---|---|---|---|---|---|---|---|
| | | NUMBER OF CLEANING | | | | | | |
| | | 90 | 180 | 360 | 540 | 720 | 900 | 1080 |
| ϕ30 TWO CLEANING PADS | 0.4 | O | O | O | O | O | O | O |
| | 0.7 | O | O | O | O | O | O | O |
| | 1 | O | O | O | O | O | O | O |
| | 1.3 | O | O | O | X | - | - | - |
| | 1.6 | O | X | - | - | - | - | - |
| | 1.8 | X | - | - | - | - | - | - |
| ϕ40 TWO CLEANING PADS | 0.4 | O | O | O | O | O | O | O |
| | 0.7 | O | O | O | O | O | O | O |
| | 1 | O | O | O | O | O | O | O |
| | 1.3 | O | O | O | O | O | O | O |
| | 1.6 | O | O | O | O | O | X | X |
| | 1.8 | O | O | O | O | X | - | - |

CLEANING DEVICE AND CHARGING DEVICE, IMAGE HOLDING UNIT AND IMAGE FORMING APPARATUS USING SAME

CROSS-REFERENCE TO RELATED APPLICATION

This application is based on and claims priority under 35 USC §119 from Japanese Patent Application No. 2007-39769 filed Feb. 20, 2007.

BACKGROUND (i) Technical Field

The present invention relates to a cleaning device and a charging device, an image bearing unit and an image forming apparatus using the same.

(ii) Related Art

As a charging device used for the known image forming apparatus, for example, a wire member such as a discharging wire has been used.

SUMMARY

According to an aspect of the invention, there is provided a cleaning device comprising:

three or more cleaning members for cleaning a wire member, the three or more cleaning members being separately disposed along a longitudinal direction of the wire member and including a pair of side cleaning members and an intermediate cleaning member, the intermediate cleaning member being disposed opposite to the pair of side cleaning members with respect to the wire member and disposed between the side cleaning members in the longitudinal direction of the wire member;

a first mechanism that moves at least one of the cleaning members so as to contact all of the cleaning members with the wire member or separate all of the cleaning members from the wire member; and a second mechanism that moves all of the cleaning members along the longitudinal direction of the wire member in a state where all of the cleaning members are contacted with the wire member.

BRIEF DESCRIPTION OF THE DRAWINGS

Exemplary Embodiments of the present invention will be described in detail based on the following figures, wherein:

FIG. 25 is a diagram illustrating a result of a durability examination of a cleaning pad against a discharge wire in Comparative Example 5.

DETAILED DESCRIPTION

Firstly, an overview of an exemplary embodiment according to the invention will be described.

Overview of Embodiment

Figure 1A:
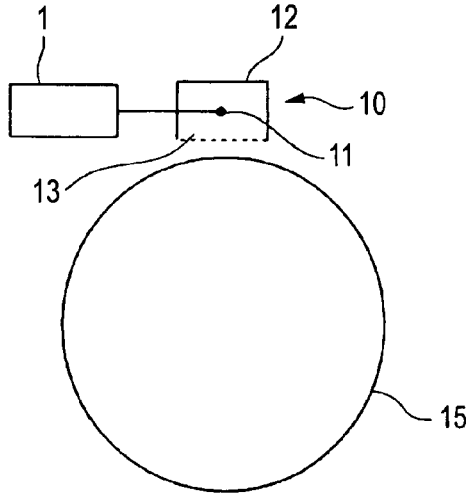
FIG. 1A is a diagram schematically illustrating an overview of an image forming apparatus according to an exemplary embodiment of the invention.
Figure 1B:
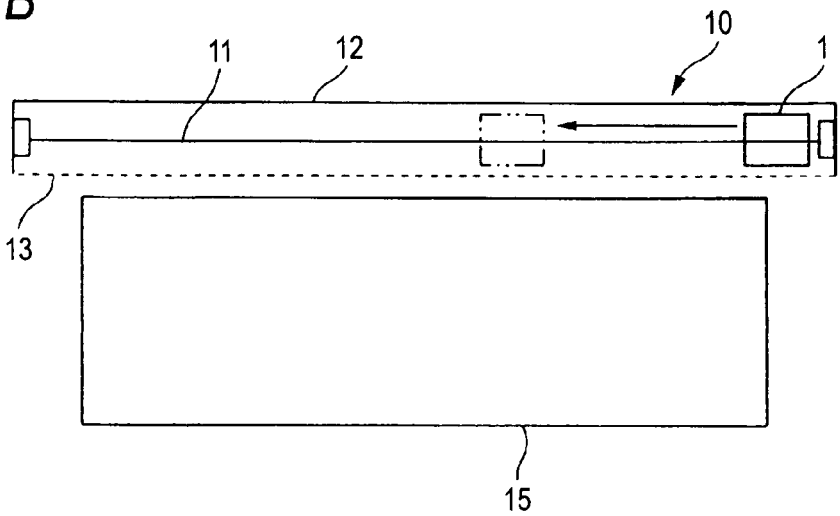
FIG. 1B is a diagram illustrating a side thereof.

FIGS. 1A and 1B show an overview of a recording member processing device according to an exemplary embodiment of the invention.

In the same figures, an image forming apparatus has an image holding member 15 for holding an image visualized from a latent image by an image forming material and a charging device 10 for charging the image holding member 15.

The image holding member 15 may be any one of a photoreceptor and a dielectric, may have any one of a drum shape and a belt shape, and may be any one of a single and a plurality depending on an image (single-color image, plural-color image) formed by the image forming apparatus.

The charging device 10 has a charging container 12 having an opening opposed to the image holding member 15, a charging wire member 11 disposed in the charging container 12, and a cleaning device 1 for cleaning the charging wire member 11.

In order to desirably keep a uniform in charging, the charging device 10 preferably has a lattice-shaped electrode 13 in the opening of the charging container 12.

Figure 1C:
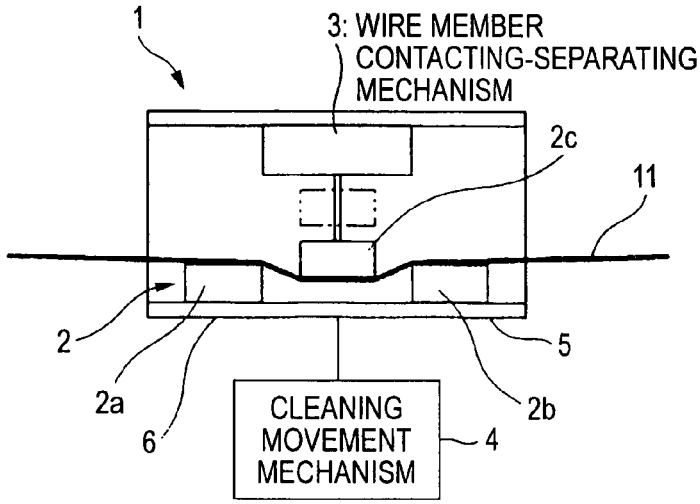
FIG. 1C is a diagram schematically illustrating a cleaning device.

In the embodiment, as shown in FIG. 1C, the cleaning device 1 includes three or more cleaning members 2 for cleaning the charging wire member 11 (three in FIG. 1), separately disposed along a longitudinal direction of the charging wire member 11; a wire member contacting-separating mechanism (a first mechanism) 3 for moving at least one of the cleaning members 2 to contact or separate all of the cleaning members 2 with or from the charging wire member 11; and a cleaning movement mechanism (a second mechanism) 4 for moving all of the cleaning members 2 along the longitudinal direction of the charging wire member 11 in a state where all of the cleaning members 2 are contacted with the charging wire member 11 by the wire member contacting-separating mechanism 3. In the cleaning device 1, the three or more cleaning members 2 include a pair of side cleaning members 2*a* and 2*b* disposed at an interval in the longitudinal direction of the charging wire member 11 and at least one intermediate cleaning member 2*c* disposed opposite to the pair of side cleaning members 2*a* and 2*b* with the charging wire member 11 and disposed between the side cleaning members 2*a* and 2*b* in the longitudinal direction of the charging wire member 11.

In such technical means, three or more cleaning members 2 may be provided and the cleaning members 2 may include side cleaning members 2*a* and 2*b* and at least one intermediate cleaning member 2*c*. In the same side as the intermediate cleaning member 2*c*, for example, other cleaning members may be provided in the outside of the side cleaning members 2*a* and 2*b* in the longitudinal direction of the charging wire member 11. The intermediate cleaning member 2*c* may be provided in any position (middle position) between the side cleaning members 2*a* and 2*b*, and plural intermediate cleaning members 2*c* may be provided.

The wire member contacting-separating mechanism 3 may move at least one of the cleaning members 2. However, it is required for the wire member contacting-separating mechanism 3 to contact or separate all of the cleaning members 2 with or from the charging wire member 11.

The cleaning movement mechanism 4 may move the cleaning members 2, which is contacted with the charging wire member 11 by the wire member contacting-separating mechanism 3, along the longitudinal direction of the charging wire member 11. The distance or direction may be appropriately determined.

In such a cleaning device 1, as an illustrative embodiment of the cleaning members 2, the cleaning members 2 may include an elastic member, a non-woven fabric is provided on a surface of the elastic member, and an abrasive (that is not limited to a layer shape and may include an aspect in which powder particles are applied) is provided on a surface of the non-woven fabric having an abrasion function.

To simplify the configuration of the cleaning member 1, the side cleaning members 2*a* and 2*b* and the intermediate cleaning member 2*c* may include a common configuration.

In order to further stabilize a moving posture of the side cleaning members 2*a* and 2*b* in different moving directions of the cleaning members 2, the intermediate cleaning member 2*c* may disposed in the center between the side cleaning members 2*a* and 2*b* in the longitudinal direction of the charging wire member 11.

The wire member contacting-separating mechanism 3 may movably hold the intermediate cleaning member 2*c* in a direction perpendicular to the longitudinal direction of the charging wire member 11 and may move the intermediate cleaning member 2*c* to contact or separate all of the side cleaning members 2*a* and 2*b* and the intermediate cleaning member 2*c* with or from the charging wire member 11.

To easily adjust the cleaning performance of the cleaning members 2, the intermediate cleaning member 2*c* may be moved to adjust oblique angles of the wire member, which is located between the intermediate cleaning member 2*c* and the side cleaning members 2*a* and 2*b*, with respect to the cleaning members 2.

A support member 5 for supporting the cleaning members 2 may be provided and the wire member contacting-separating mechanism 3 may be provided so that the side cleaning members 2*a* and 2*b* are fixedly attached to the support member 5, the intermediate cleaning member 2*c* is movably attached, and the charging wire member 11 is bent to bring the side cleaning members 2*a* and 2*b* and the charging wire member 11 in contact with each other when the intermediate cleaning member 2*c* comes in contact with the charging wire member 11.

As to the disposition relation between the side cleaning member 2*a* and 2*b* and the intermediate cleaning member 2*c* contacted with the charging wire member 11, k/d may be in the range of about 0.2 to about 0.7 where d denotes a distance between the intermediate cleaning member 2*c* and the side cleaning members 2*a* and 2*b* in the longitudinal direction of the charging wire member 11 and k denotes a biting distance corresponding to a relative difference between a position of the side cleaning members 2*a* and 2*b* contacted with the charging wire member 11 and a position of the intermediate cleaning member 2*c* contacted with the charging wire member 11.

The reason is that a pressing force of the cleaning members 2 to the charging wire member 11 is insufficient at the ratio smaller than 0.2, and the pressing force is excessive at the ratio larger than 0.7 and thus the cleaning members 2 may be rapidly damaged. The reason will be proved by examples to be described later.

To maintain the cleaning performance of the cleaning device 1, the cleaning movement mechanism 4 may reciprocate along the longitudinal direction of the charging wire member 11 in a state where all of the cleaning members 2 are contacted with the charging wire member 11 by the wire member contacting-separating mechanism 3.

In this case, when the movement direction is changed by the cleaning members 2, the contact to the charging wire member 11 may be kept. However, to sufficiently suppress the damage of the cleaning members 2, the cleaning members 2 may be temporally separated from the charging wire member 11 and then are contacted with the charging wire member 11 again when the movement direction is changed by the cleaning members 2.

To reliably maintain the charging performance of the charging device 10, any of the cleaning members 2 for the charging device 10 may clean the charging wire member 11 close to an image holding member 15 as a charging target.

To effectively prevent the cleaning device 1 from being dirtied due to foreign materials when the charging device 10 is disposed above the image holding member 15 as the charging target, the cleaning movement mechanism 4 of the cleaning device 1 may include a cleaning reception member 6 which is provided below the side cleaning members 2*a* and 2*b* and the intermediate cleaning member 2*c* so as to cover them and which moves together with all of the cleaning members 2.

To reliably maintain the charging performance of the charging device 10, the cleaning device 1 for the charging device 10 may include a cleaning-device waiting room where the cleaning device 1 waits at a non-cleaning time in the vicinity of an end portion of the charging wire member 11 in the longitudinal direction of the charging wire member 11 and deviated from an electrifiable area of a charging container 12, and may move the cleaning device 1 from the cleaning-device waiting room at a cleaning time.

Next, performance of the cleaning device used as the embodiment shown in FIG. 1 will be described.

Figure 2A:
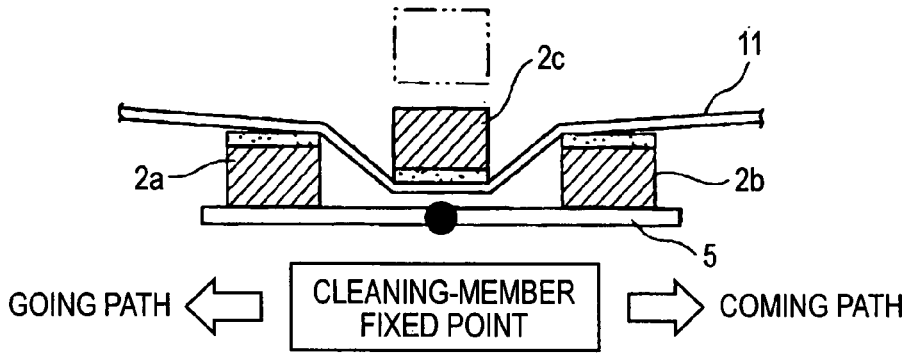
FIG. 2A is a diagram illustrating an overview of movement of a cleaning device used as the embodiment shown in FIG. 1.

As shown in FIG. 2A, for example, it is assumed that the intermediate cleaning member 2*c* is moved by the wire member contacting-separating mechanism 3 (see FIG. 1), the side cleaning members 2*a* and 2*b* are fixed to the support member 5, the side cleaning members 2*a* and 2*b* and the intermediate cleaning member 2*c* are contacted or separated with or from the charging wire member 11, and the cleaning members 2 (2*a* to 2*c*) move in the going and coming directions indicated by arrows with all of the cleaning members 2 (2*a* to 2*c*) contacted with the charging wire member 11.

Figure 2B:
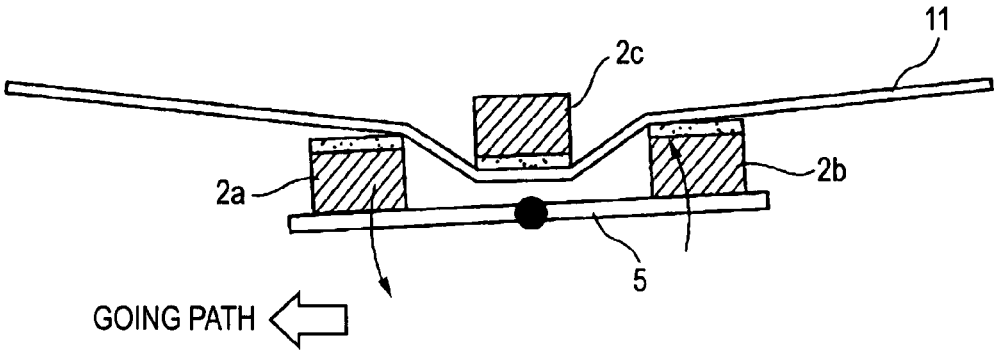
FIG. 2B is a diagram illustrating movement of the cleaning device at the time of moving in a going path.
Figure 3A:
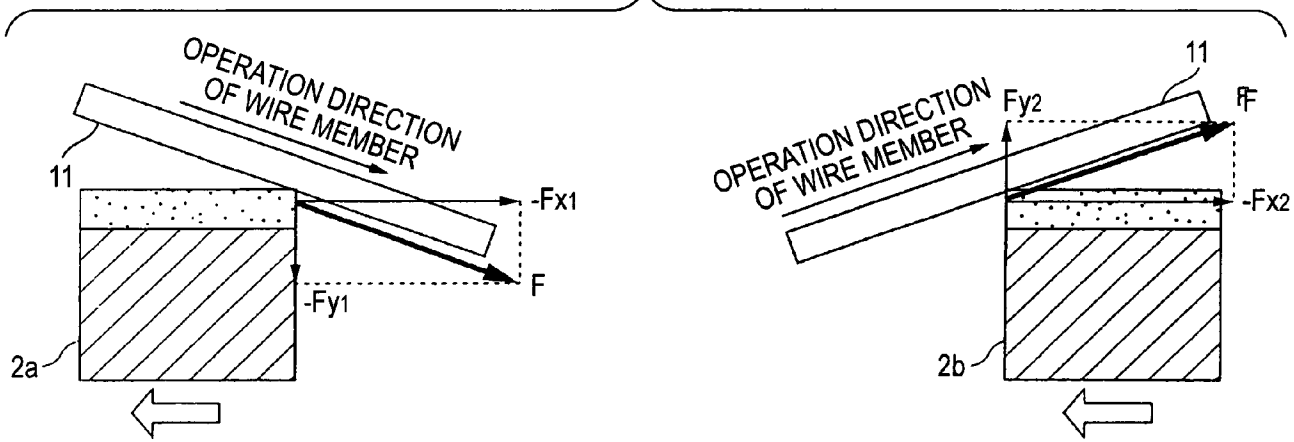
FIG. 3A is a diagram illustrating the force acting on the side cleaning members in FIG. 2B.

As shown in FIG. 2B, when all of the cleaning members 2 (2*a* to 2*c*) move in the going direction indicated by an arrow, the charging wire member 11 moves relatively as moving the side cleaning member 2*a* located in the going and coming direction with the intermediate cleaning member 2*c* interposed therebetween, as shown in FIG. 3A. An active force F (−Fx1, −Fy1) acts on the side cleaning member 2*a* in an operative direction of the charging wire member 11 facing from the side cleaning member 2*a* to the intermediate cleaning member 2*c*, and thus the side cleaning member 2*a* is inclined in a direction apart from the charging wire member 11 about the cleaning-member fixed point as the central fixed point of the support member 5.

Meanwhile, in the side cleaning member 2*b* located on the side opposite to the going direction with the intermediate cleaning members 2*c* interposed therebetween, the charging wire member 11 moves relatively as the side cleaning member 2*b* moves, as shown in FIG. 3A. An active force F (−Fx2, Fy2) acts on the side cleaning member 2*b* in the operative direction of the charging wire member 11 facing from the side cleaning member 2*b* to the intermediate cleaning member 2*c*, and thus the side cleaning member 2*b* is inclined in a direction close to the charging wire member 11 about the cleaning-member fixed point that is the central fixed point of the support member 5.

Figure 2C:
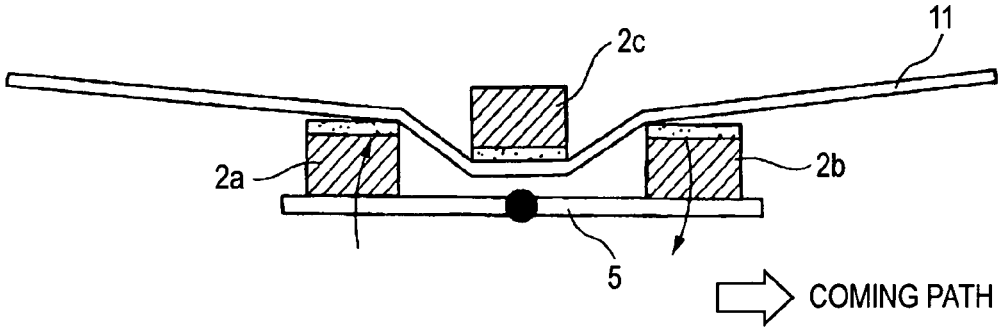
FIG. 2C is a diagram illustrating movement of the cleaning device at the time moving in a coming path.
Figure 3B:
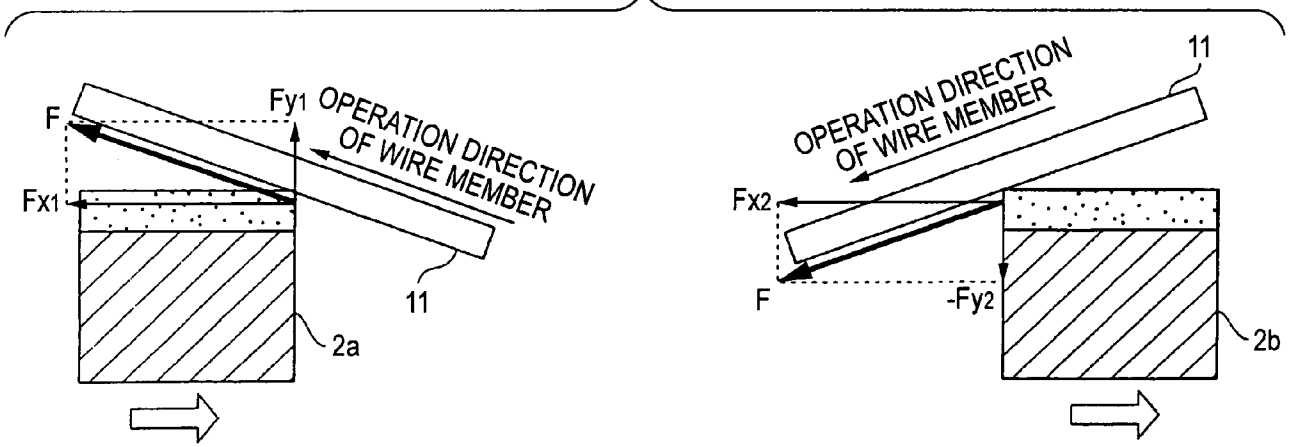
FIG. 3B is a diagram illustrating the force acting on the side cleaning members in FIG. 2C.

On the other hand, as shown in FIG. 2C, when all of the cleaning members 2 (2*a* to 2*c*) move in the coming direction indicated by an arrow, the charging wire member 11 relatively moves due to the movement of the side cleaning members 2*b* with the intermediated cleaning member 2*c* interposed therebetween in the coming direction as shown in FIG. 3B. An active force F (Fx2, −Fy2) acts on the side cleaning members 2*b* in an operative direction of the charging wire member 11 facing from the side cleaning member 2*b* to the intermediate cleaning member 2*c* and thus the side cleaning member 2*b* are inclined in a direction away from the charging wire member 11 about the fixed point of the cleaning member that is the central fixed point of the support member 5.

Meanwhile, in the side cleaning member 2*a* located on the side opposite to the coming direction with the intermediate cleaning member 2*c* interposed therebetween, the charging wire member 11 relatively moves as the side cleaning member 2*a* moves as shown in FIG. 3B. The active force F (Fx1, Fy1) acts on the side cleaning member in the operative direction of the charging wire member 11 from the intermediate cleaning member 2*c* to the side cleaning member 2*a*, and thus the side cleaning member 2*a* is inclined in a direction close to the charging wire member 11 about a cleaning-member fixed point that is the central fixed point of the support member 5, As described above, when the cleaning members 2 move in the going and coming directions, the inclination direction of the side cleaning members 2*a* and 2*b* are opposite to each other. However, the forces for cleaning the charging wire member 11 by both side cleaning members 2*a* and 2*b* are added and thus become the same as each other. For the reason, even when the movement directions of the cleaning members 2 are different from each other, the cleaning powers of the side cleaning members 2*a* and 2*b* and the intermediate cleaning member 2*c* are kept be substantially equal. Accordingly, it is suppressed that the cleaning powers of the cleaning members 2 are dramatically reduced, due to the difference in the movement directions of the cleaning members 2.

Figure 4A:
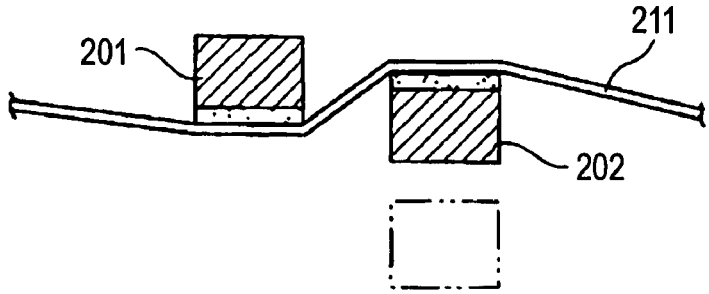
FIG. 4A is a diagram illustrating an overview of movement of a cleaning device used as a comparative embodiment.

The performance of the embodiment model is evaluated in comparison with the comparative embodiment shown in FIG. 4A.

In the comparative embodiment, it is assumed as follows. Two cleaning members 201 and 202 are disposed so that a charging wire member 211 is interposed therebetween. For example, the cleaning member 202 are disposed in a contacting-separating movement mechanism (not shown) so as to be contacted and separated. The other cleaning member 201 is fixedly disposed in a support member (not shown). The two cleaning members 201 and 202 move in going and coming directions indicated by arrows with the two cleaning members 201 and 202 contacted with the charging wire member 211.

Figure 4B:
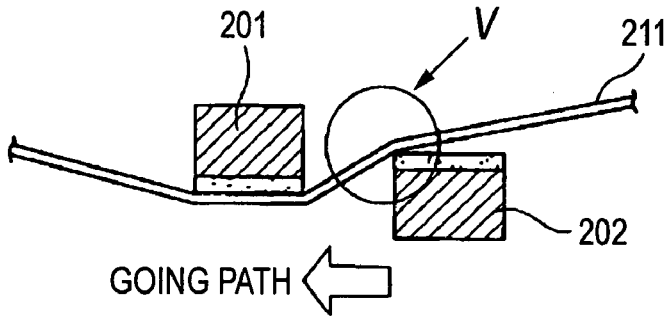
FIG. 4B is a diagram illustrating movement of the cleaning device at the time of moving in a going path, and FIG. 4C a diagram illustrating movement of the cleaning device at the time moving in a coming path.
Figure 5A:
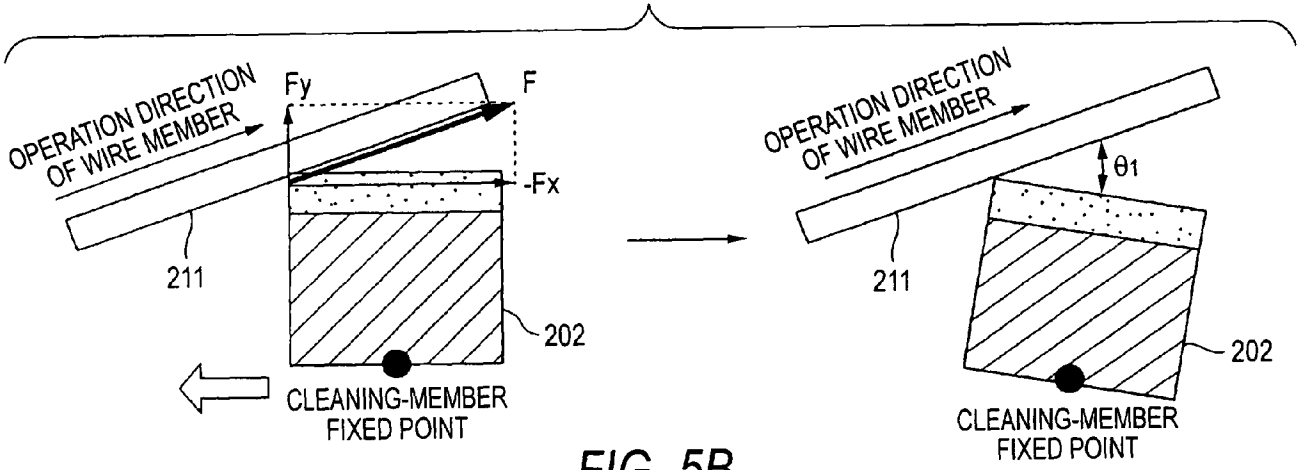
FIG. 5A is a diagram illustrating the force acting on a V portion in FIG. 4B.

When the two cleaning members 201 and 202 move in the going direction indicated by the arrow as shown in FIG. 4B, in the cleaning member 202 located on the side opposite to the going direction, the charging wire member 211 relatively moves as the cleaning member 202 moves as shown in FIG. 5A. A force F (−Fx, Fy) acts on the cleaning member 202 in an operative direction of the charging wire member 211 facing from the cleaning member 201 to the other cleaning member 202, the cleaning member 202 is contacted with the charging wire member 211 about a fixed point of the cleaning member 202. Accordingly, the cleaning member 202 is inclined at an angle θ1 in a direction away from the charging wire member 211.

Figure 4C:
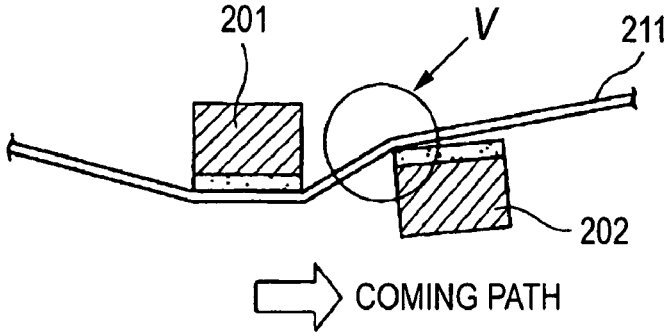
Figure 5B:
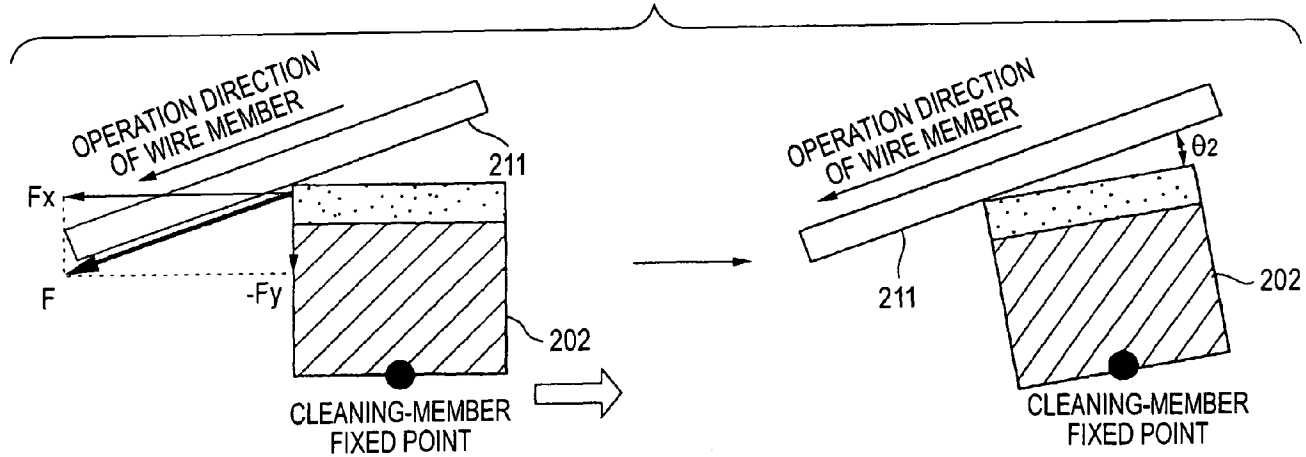
FIG. 5B is a diagram illustrating the force acting on a V portion in FIG. 4C.

Meanwhile, as shown in FIG. 4C, when two cleaning members 201 and 202 move in a coming direction represented by an arrow, the charging wire member 211 relatively moves as the cleaning member 202 disposed in the coming direction moves as shown in FIG. 5B. An active force F (Fx, −Fy) acts on the cleaning member 202 in an operative direction of the charging wire member facing from the cleaning member 202 to the other cleaning member 201. The cleaning member 202 moves in a direction away from the charging wire member 211 about the fixed point of the corresponding cleaning member and is inclined at an angle θ2 (θ2<θ1) in a direction close to the charging wire member 211.

In the comparative example as described above, when the cleaning members 201 and 202 move in the directions of the going and coming directions, the directions in which the cleaning member 202 is inclined to the charging wire member 211 are different from each other. Accordingly, a difference in cleaning power of the cleaning member 202 in the going and coming directions occurs, and thus the cleaning power may be insufficient in accordance with the movement directions of the cleaning members 201 and 202.

Hereinafter, the invention will be described in detail with reference to an exemplary embodiment shown in the accompanying drawings.

Embodiment 1

Figure 6:
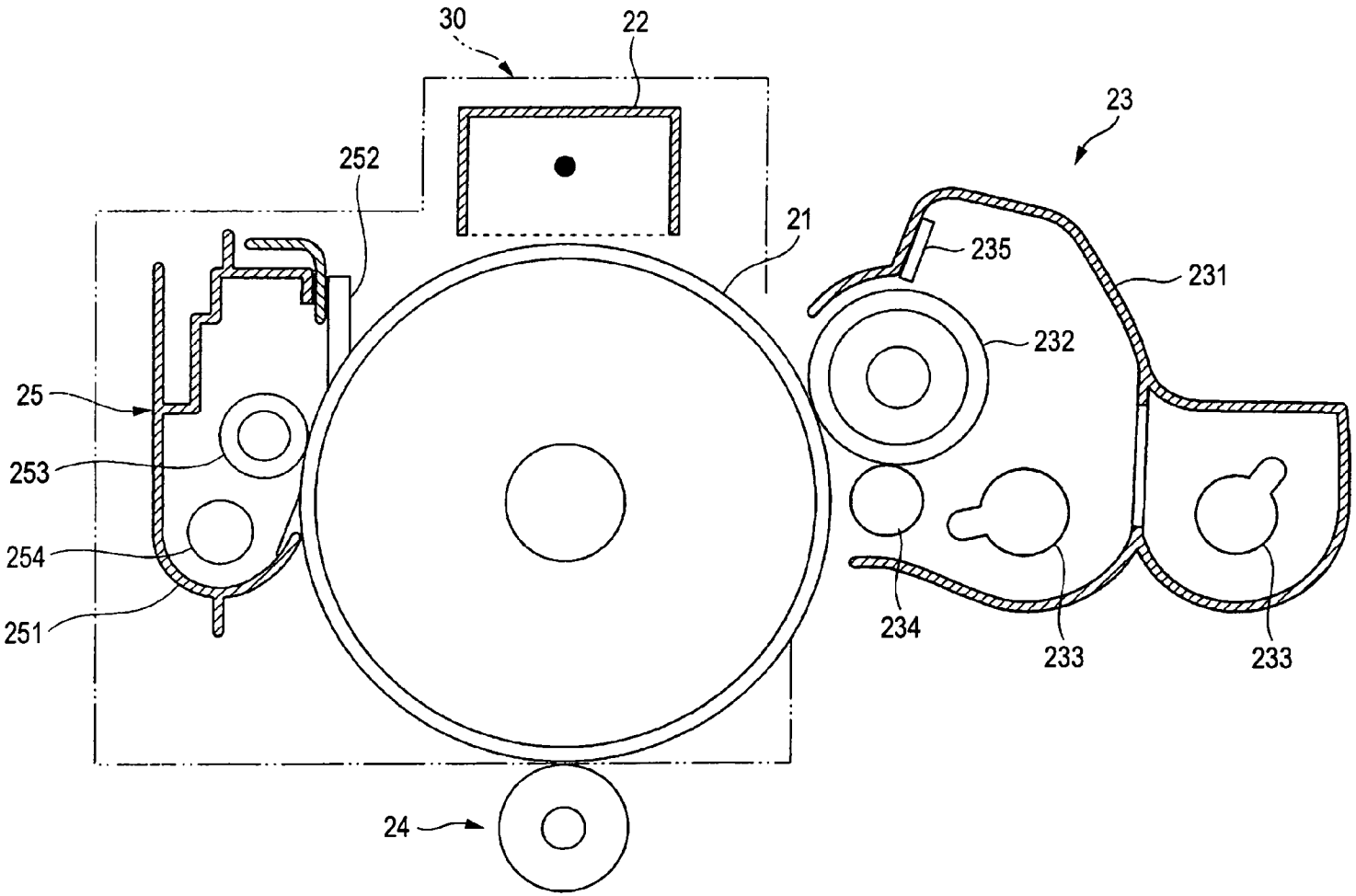
FIG. 6 is a diagram illustrating Embodiment 1 of an image forming apparatus of the invention.

FIG. 6 is a diagram illustrating Embodiment 1 of an image forming apparatus of the invention. In the same figure, the image forming apparatus includes a photoreceptor 21 as an image holding member rotating in a direction, a charging device 22 for charging the photoreceptor 21, an exposure device as a latent-image recording device for recording an electrostatic latent image on the charged photoreceptor 21, a development device 23 for visualizing the electrostatic latent image on the photoreceptor 21 by a developer, a transfer device 24 for transferring the image on the photoreceptor 21 visualized by the developer to a recording member (not shown) or an intermediate transfer member (not shown), and an image cleaning member 25 for cleaning the image which is visualized by the development and remains on the photoreceptor 21.

As the development device 23, any one of a 1-component developing method and a 2-component developing method may be appropriately selected. In the embodiment, the 2-component developing method is used (for example, a development roll 232 is disposed in a development container 231 receiving a 2-component developer, a mix-transport member 233 mixing and transporting the developer is disposed in the development container 231, the developer mixed and transported by the mix-transport member 233 is supplied to the development roll 232 using a developer supplying roll 234 or the like, a lay thickness of the developer on the development roll 232 is restricted by a layer-thickness restricting member 235, and the developer is supplied to a development area opposed to the photoreceptor 21).

The transfer device 24 is not limited to the device using the transfer roll as long as the transfer device 24 has a function for transferring the visual image on the photoreceptor 21 to the recording member or the intermediate transfer member, but may be a device using a discharge wire. In the embodiment, when the device using the discharge wire is employed, the configuration of the device using the discharge wire may be used as the charging device 22.

As the image cleaning device 25, a device cleaning the developer remaining on the photoreceptor 21 may be appropriately selected. In the embodiment, for example, there is used a device in which a plate-shaped cleaning blade 252 and a cleaning brush 253 are disposed in a cleaning container 251, and a uniformity transport member 254 allowing a recalled remaining developer to be uniform is disposed in the cleaning container 251.

Figure 7:
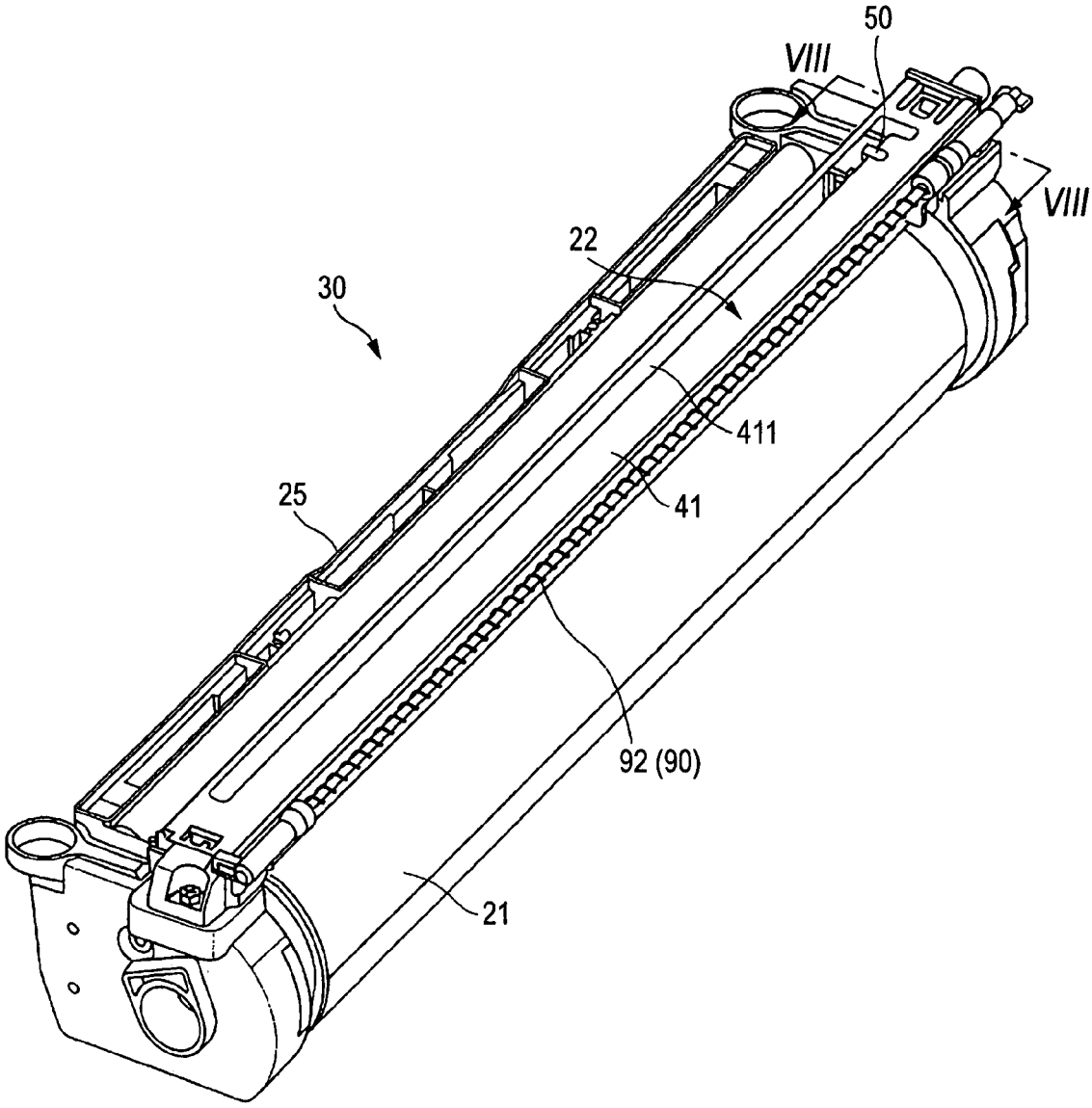
FIG. 7 is a diagram illustrating the whole configuration of an image bearing unit used in Embodiment 1.

In the embodiment, as shown in FIGS. 6 and 7, the photoreceptor 21, the charging device 22, and the image cleaning device 25 are integrated into one unit as an image holding unit 30.

Figure 8:
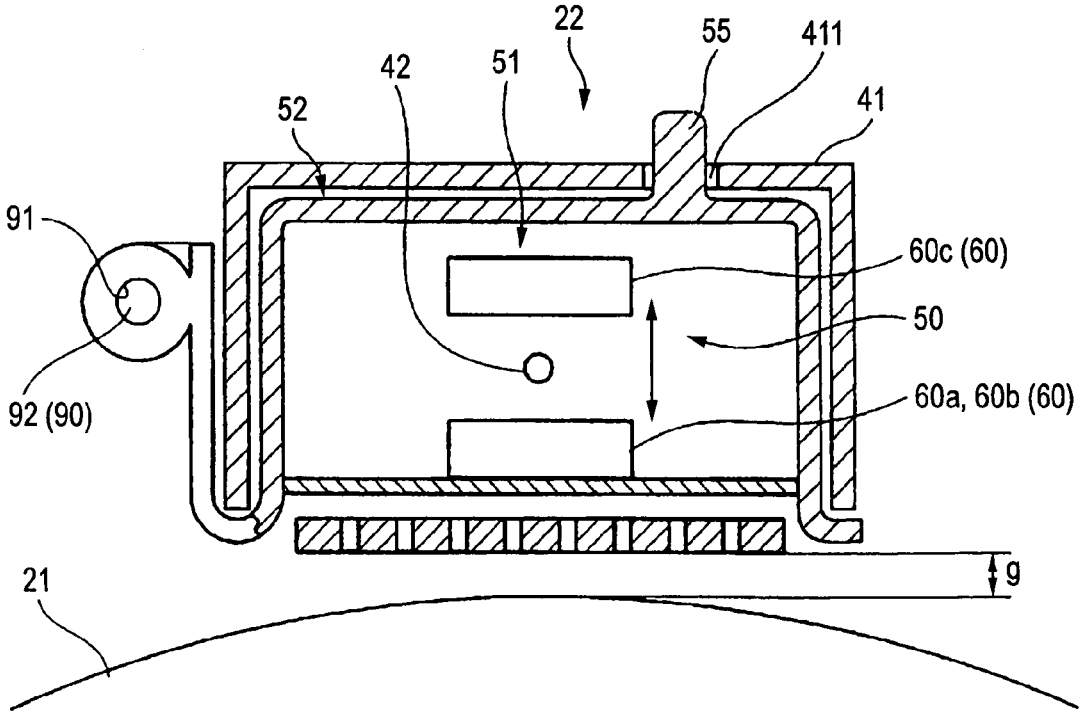
FIG. 8 is a cross sectional view taken along Line VIII-VIII in FIG. 7.
Figure 9:
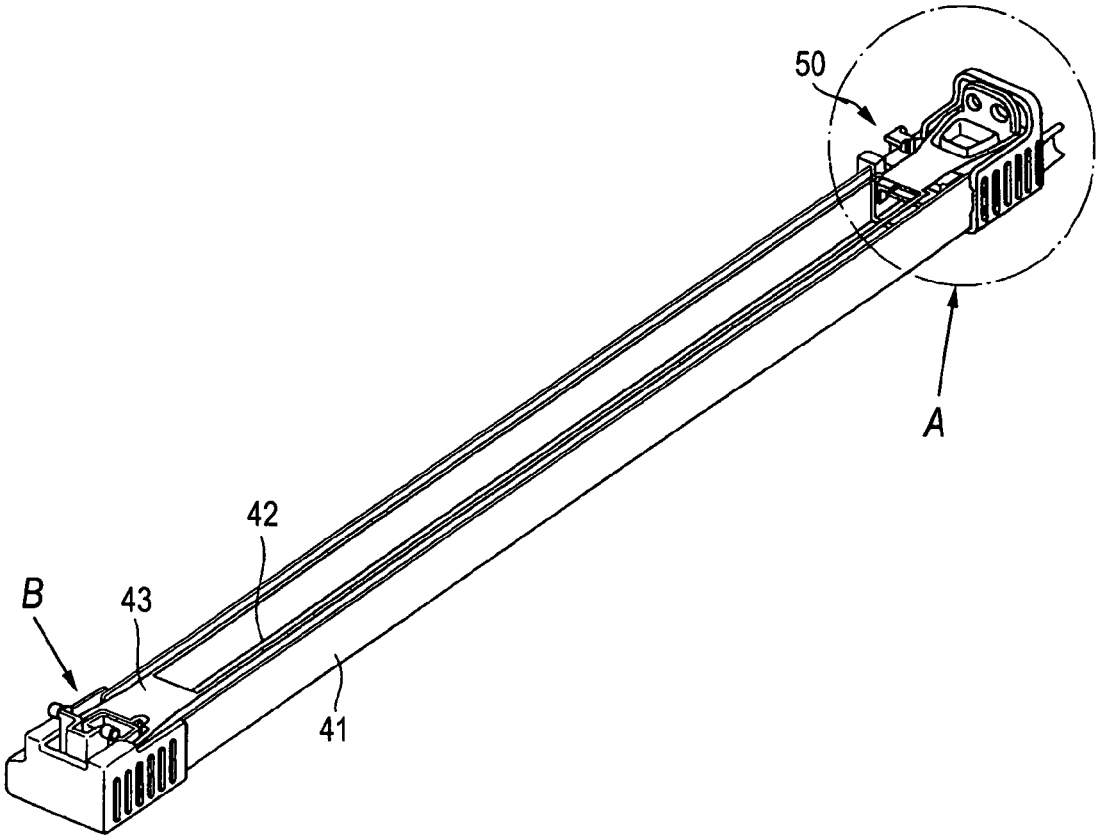
FIG. 9 is a perspective view illustrating a charging device used in Embodiment 1 as viewed from a photoreceptor.
Figure 10A:
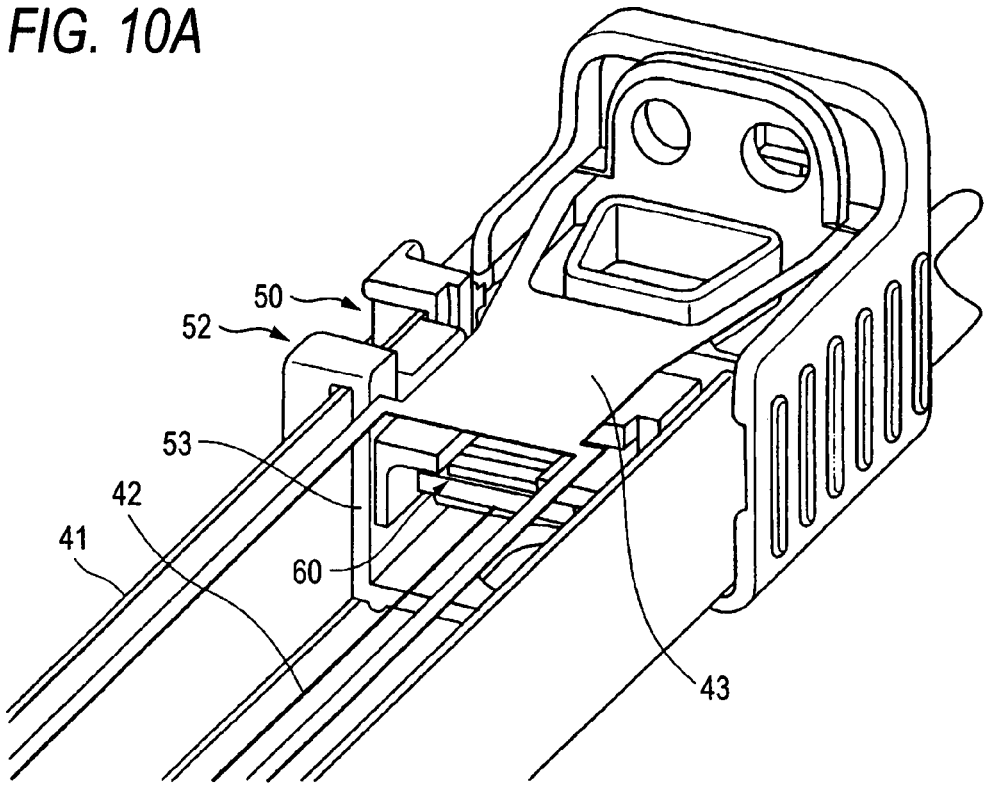
FIG. 10A is a diagram illustrating an A portion in detail in FIG. 9.
Figure 10B:
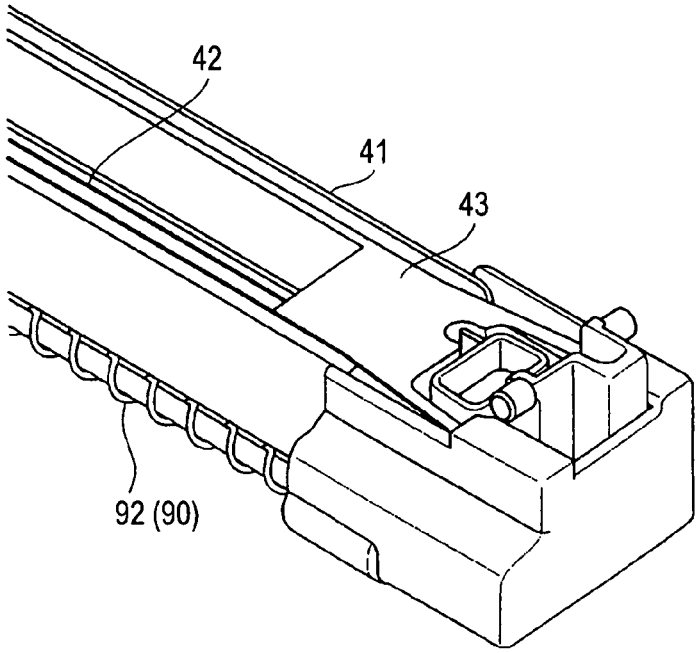
FIG. 10*b* is a diagram as viewed in a direction represented by Arrow B in FIG. 9.

The charging device 22 includes a substantially U-shaped charging container 41, a discharge wire 42 (see FIG. 8), and a lattice-shaped electrode 43 (the lattice-shaped electrode 43 is omitted after FIG. 9). The charging container 41 disposed in non-contact with the photoreceptor 21 with a gap above the photoreceptor 21, extends along an axial direction of the photoreceptor 21, is made of materials for preventing discharge, and opens toward the photoreceptor 21. The discharge wire 42 as the charging wire member is provided along the longitudinal direction of the charging container 41. The electrode 43 is provided in the opening portion of the charging container 41 and adjusts a charging potential.

Figure 11:
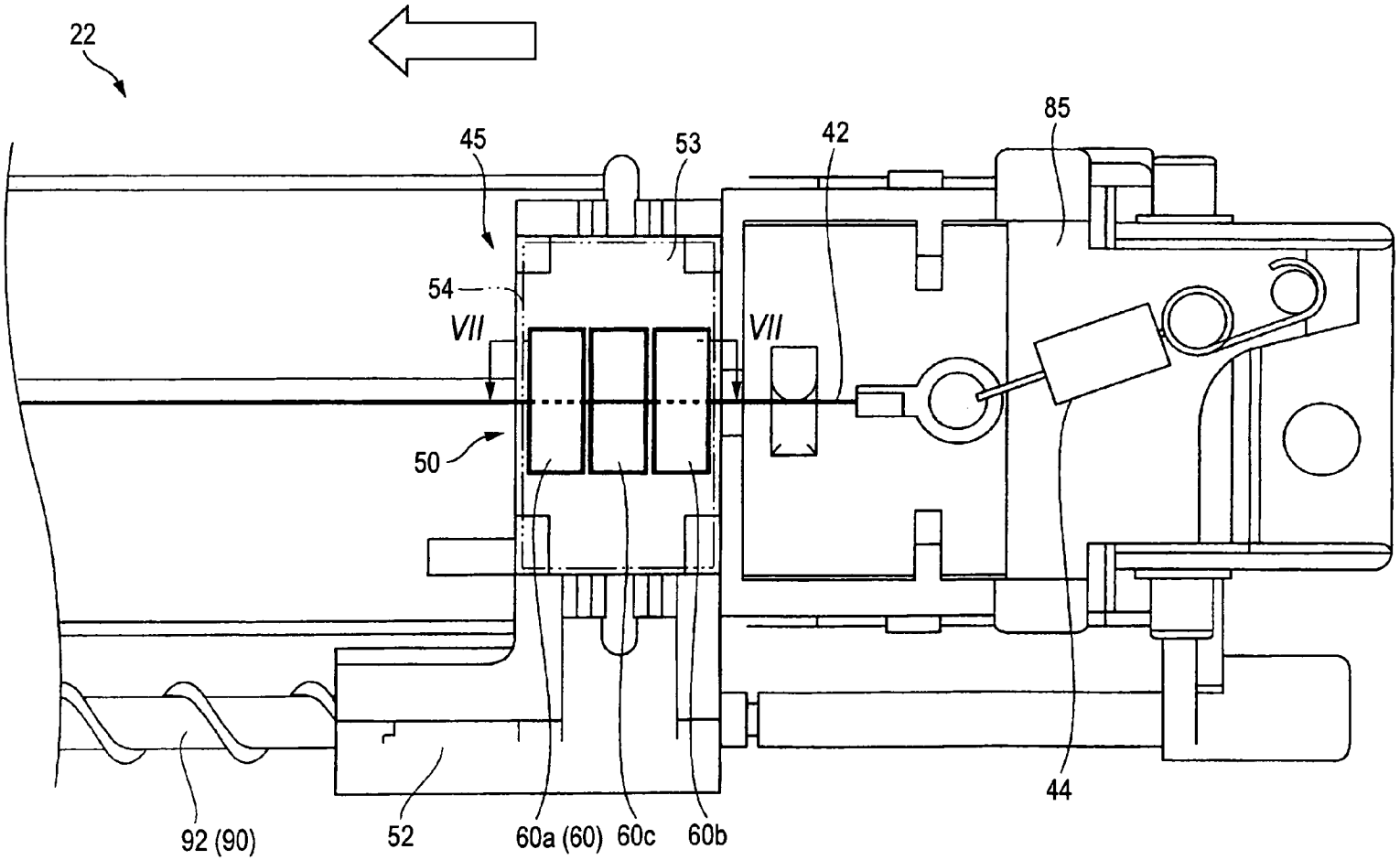
FIG. 11 is a diagram illustrating the vicinity of the cleaning device mounted on the charging device used in Embodiment 1 as viewed from the photoreceptor.

The discharge wire 42 is provided between insulation members at both ends in the longitudinal direction of the charging container 41 with at least one tension-urging elastic spring 44 (see FIG. 11) interposed between the discharge wire 42 and one end or the other end. The discharge wire 42 is connected to a discharge bias power source (not shown). One discharge wire 42 may be provided, but a plurality of discharge wires 42 may be provided.

As the discharge wire 42, for example, a wire with a diameter in the range of 30 μm to 40 μm made of tungsten, carbon tungsten, gold-coating tungsten, and the like with is used, and a tension force thereof is set substantially in the range of about 30 to about 80 gf (about 0.29 to about 0.78 N).

In the embodiment, the charging device 22 has a cleaning device 50 to regularly clean the discharge wire 42 as shown in FIGS. 8 to 12.

In the embodiment, the charging container 41 is formed to be longer than the maximum image forming area in the axial direction of the photoreceptor 21. A cleaning-device waiting room 45 where the cleaning device 50 waits is provided at one side of the charging container 41.

The cleaning device 50 has a cleaning tool 51 for cleaning the discharge wire 42 and a cleaning movement mechanism 90 for moving the cleaning tool 51 along the longitudinal direction of the charging container 41.

In the embodiment, the cleaning tool 51 has a movable table 52 which is movable along the longitudinal direction of the charging container 41, and three cleaning pads 60 (60*a* to 60*c*) disposed separately along the longitudinal direction of the discharge wire 42 is provided in the movable table 52.

The movable table 52 has a frame-shaped support frame 53 slid along the longitudinal direction of the charging container 41. The support frame 53 is provided with a cleaning reception member 54 covering the lower side of the cleaning pads 60 (60*a* to 60*c*) and an guide protrusion 55 slidably fitted to a guide groove 411 which is formed in the top portion of the charging and extends along the longitudinal direction.

In the embodiment, a pair of side cleaning pads 60*a* and 60*b* capable of coming in contact with the side of the photoreceptor 21 of the discharge wire 42 are fixedly disposed on the cleaning reception member 54. In the side opposite to the direction in which the discharge wire 42 is interposed and in the substantially central portion between the side cleaning pads 60*a* and 60*b*, an intermediate cleaning pad is disposed to move to the support frame 53 with the wire member contacting-separating mechanism 70 (see FIG. 12) interposed therebetween.

Figure 12A:
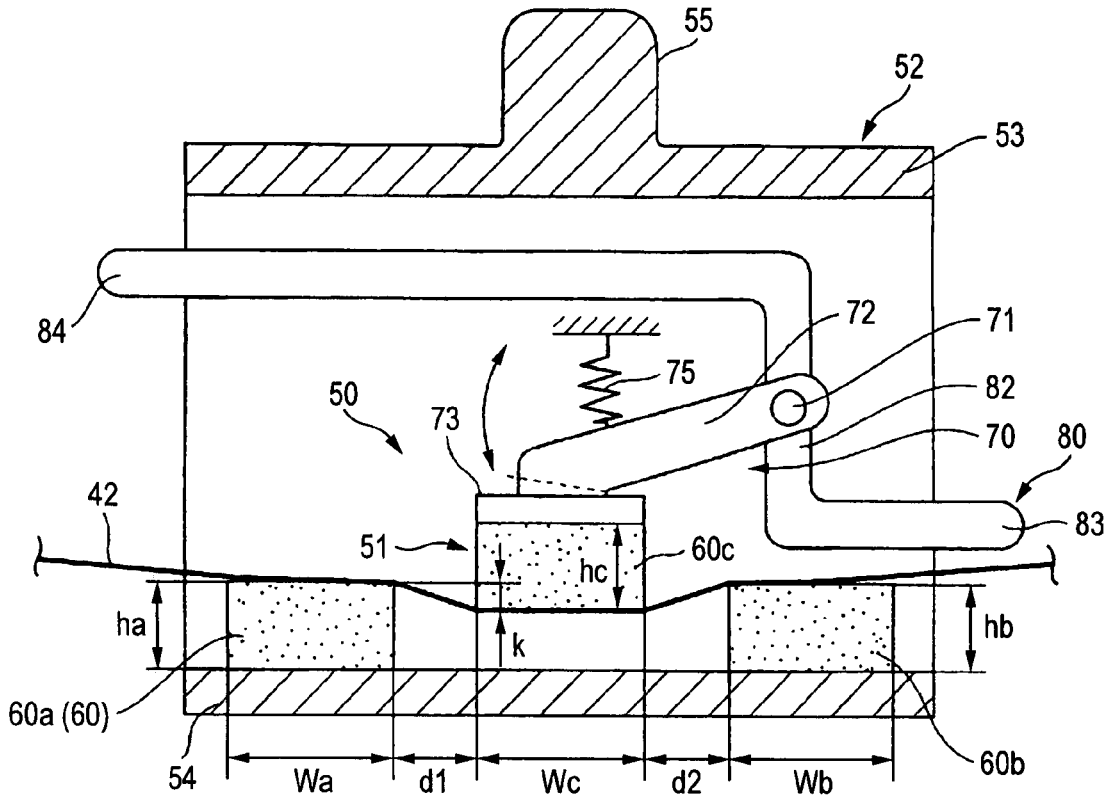
FIG. 12A is a cross sectional view taken along Line VII-VII.

In the embodiment, in the wire member contacting-separating mechanism 70, as shown in FIG. 12A, a vibration arm which vibrates about a vibration axis 71 is provided in the support frame 53, the intermediate cleaning pad 60*c* is fixedly disposed on a fixed receiving portion 73 provided at a free end of the vibration arm 72, the intermediate cleaning pad 60*c* moves between a retreat position coming in non-contact with the discharge wire 42 and a cleaning position contacted with the discharge wire 42, and the intermediate cleaning pad 60*c* is urged by pressing the vibration arm 72 toward the cleaning position of the intermediate cleaning pad 60*c* by the use of an urging spring 75. The vibration arm 72 is stopped at the cleaning position by a stopper (now shown).

The wire member contacting-separating mechanism 70 vibrates the vibration arm 72 by the urging force of the urging spring 75 to set the intermediate cleaning pad 60*c* to be at the cleaning position, and a part of the discharge wire 42 corresponding to the intermediate cleaning pad 60*c* is pressed down, thereby bring parts of the discharge wire 42 corresponding to the side cleaning pads 60*a* and 60*b* in contact with the side cleaning pads 60*a* and 60*b*.

In the embodiment, as shown in FIG. 12A, it is preferable to set w=about 3 to about 5 mm, h=about 1 to about 2 mm, d=about 0.5 to about 1.5 mm, and k=about 0.4 to about 1.8, where w (wa to wc) denotes widths of the cleaning pads 60 (60*a* to 60*c*) along the longitudinal direction of the discharge wire 42, h (ha to hc) denotes thicknesses of the same, d (d1, d2) denotes distances between the cleaning pads 60 along the longitudinal direction of the discharge wire 42, k denotes a biting distance corresponding to a difference between contact surfaces of the side cleaning pads 60*a* and 60*b* to the discharge wire and a contact surface of the intermediate cleaning pad 60*c* to the discharge wire.

Particularly, it is preferable to set k/d to be in the range of about 0.2 to about 0.7.

This will be supported by embodiments to be described later.

In the embodiment, sizes or dispositions of the cleaning pads 60 (60*a* to 60*c*) may be individually set. However, in order to reduce a difference in cleaning due to the movement direction of the cleaning tool 51, it is preferable that the cleaning pads 60 (60*a* to 60*c*) have the same configuration and the dispositions of the side cleaning pads 60*a* and 60*b* with the intermediate cleaning pad 60*c* interposed therebetween are set in the same manner.

In the embodiment, the cleaning pads 60 (60*a* to 60*c*) may be appropriately selected as long as the discharge wire 42 is cleaned. However, in consideration of the cleaning performance, the cleaning pads 60 (60*a* to 60*c*) have, for example, the same configuration as follows.

Figure 12B:
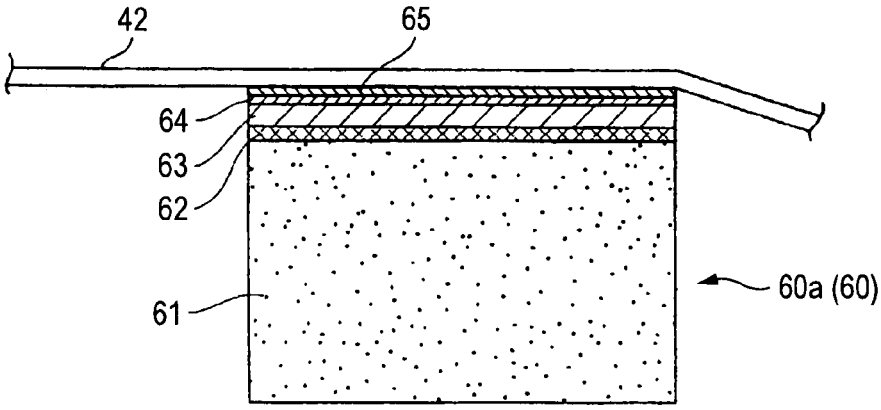
FIG. 12B is a diagram illustrating a constitution example of a cleaning pad used in Embodiment 1.

That is, as shown in FIG. 12B, the cleaning pads 60 is formed as follows: an elastic member 61 having porosity and flexibility such as a sponge, a felt, and foaming resin is provided, a non-woven fabric 63 on which a uneven process is performed is adhered on the elastic member 61 by adhesive, a powder layer is provided on the surface of the non-woven fabric 63, an abrasive 65 having an abrasive function such as alumina, carbon random, and diamond is mixed with an adhesive 62 and is applied on the powder layer 64, or the adhesive 62 is applied on the surface of the non-woven fabric 63, the abrasive 65 is sprayed, and the adhesive 62 is thinly applied thereon.

The non-woven fabric widely includes a thing formed by adhering a fiber or a thing related to the fabric.

In the embodiment, the wire member contacting-separating mechanism 70 has a retreat mechanism 80 to retreat the intermediate cleaning pad 60*c* to the retreat position at the time when the cleaning tool 51 is located at an initial position and at an end portion opposite to the charging container 41.

Figure 13:
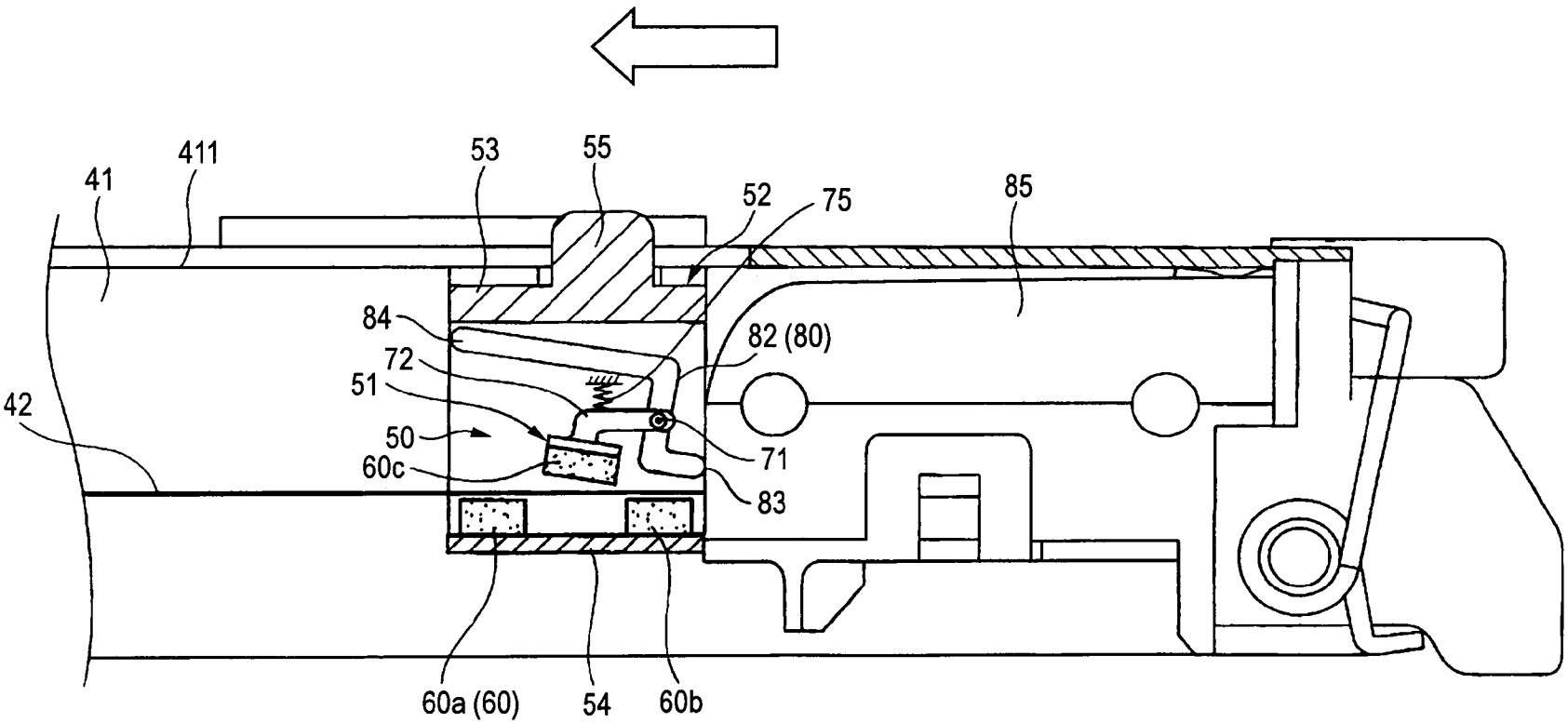
FIG. 13 is a diagram illustrating a state at an initial position of a cleaning device.
Figure 14:
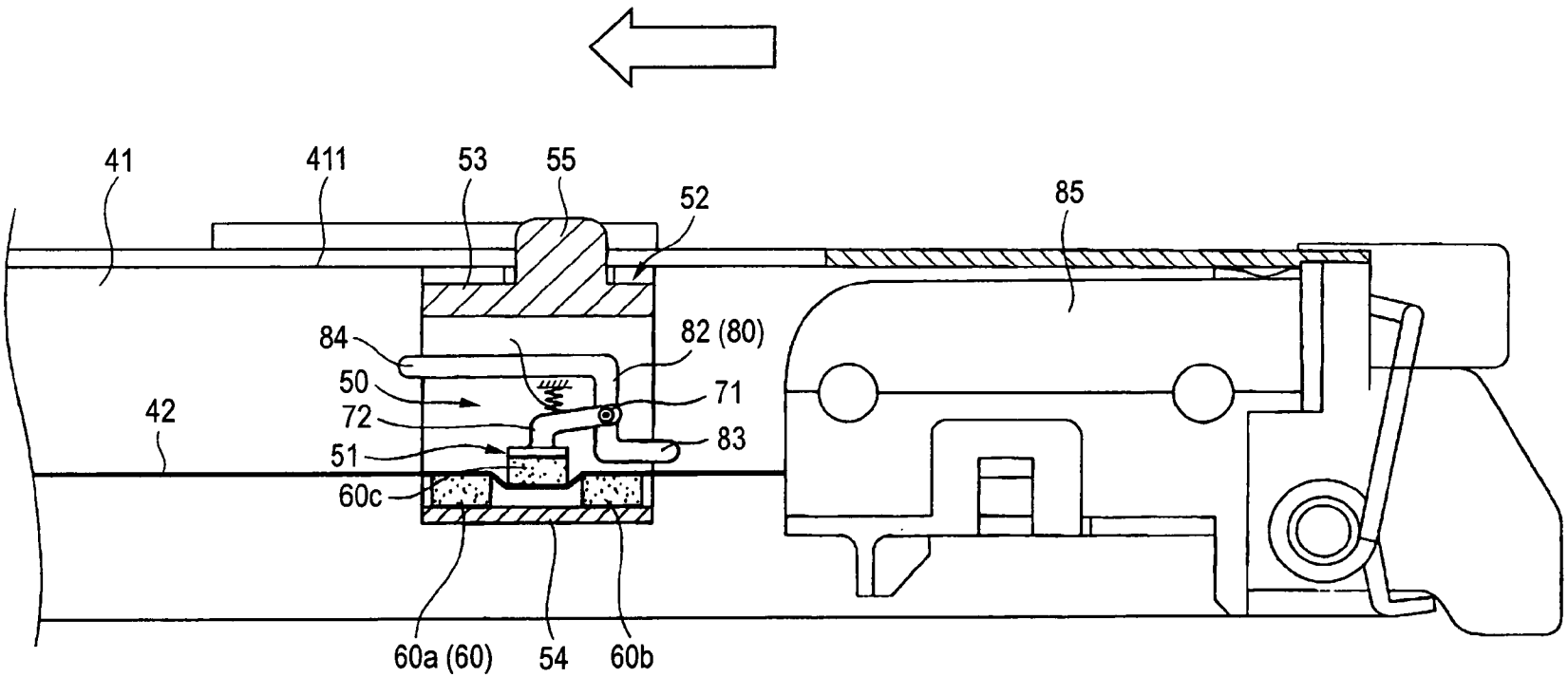
FIG. 14 is a diagram illustrating a state just after the cleaning device starts moving from the initial position.
Figure 15:
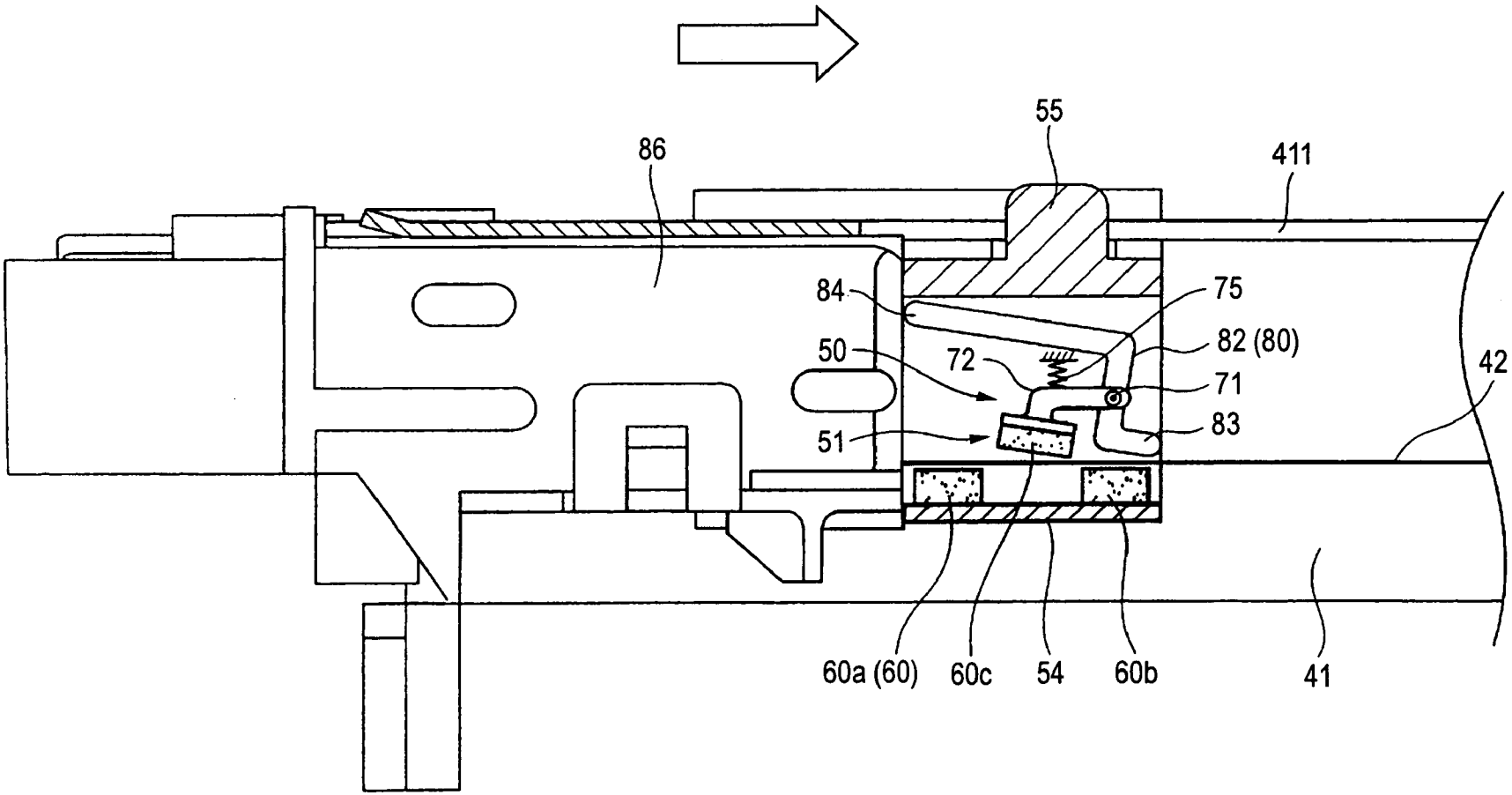
FIG. 15 is a diagram illustrating a state at the time when the cleaning device reaches an end portion opposite to the initial position.

As shown in FIGS. 13 to 15, the retreat mechanism 80 has a retreat vibration arm 82 crossing with the vibration arm 72 and extending from the vibration axis 71 of the vibration arm 72 as a vibration point in both directions of the vibration axis 71. Protruding portions 83 and 84 which each protrude from the cleaning tool 51 at the time when the intermediate cleaning pad 60*c* is set to the cleaning position are provided at both free ends of the retreat vibration arm 82. For example, convex-shaped closing members 85 and 86 are disposed at both ends of the charging container 41.

In the embodiment, for example, when the cleaning tool 51 is located at the initial position, the intermediate cleaning pad 60*c* moves to the retreat position by vibrating the retreat vibration arm 82 so as to push the protruding portion 83 against the closing member 85 into the cleaning tool 51 (see FIG. 13). In this state, the cleaning pads 60 (60*a* to 60*c*) is disposed so as not to be contacted with the discharge wire 42.

When the cleaning tool 51 moves from the initial position along the longitudinal direction of the charging container 41, as shown in FIG. 14, a restraint on the position between the protruding portion 83 of the retreat vibration arm 82 and the closing member 85 is removed in accordance with the movement of the cleaning tool 51. As a result, the vibration arm 72 is pushed by the urging force of the urging spring 75 and thus the intermediate cleaning pad 60*c* is changed from the retreat position to the cleaning position. Consequently, the discharge wire 42 is disposed so as to be contacted with the cleaning pads 60 (60*a* to 60*c*).

When the cleaning tool 51 reaches the initial position and the end portion opposite to the initial position of the charging container 41, the intermediate cleaning pad 60*c* moves to the retreat position by vibrating the retreat vibration arm 82 so as to push the other protruding portion 84 against the closing member 86 into the cleaning tool 51 (see FIG. 15). In this state, the cleaning pads 60 (60*a* to 60*c*) is disposed so as not to be contacted with the discharge wire 42.

As shown in FIGS. 7 to 12, in the cleaning movement mechanism 90, a female screw portion 91 is formed in a part of the support frame 53 of the movable table 52, a ball screw shaft 92 is disposed along the longitudinal direction of the charging 41, the ball screw shaft is tightened into the female screw portion 91, the ball screw shaft is rotated by a driving motor 93 (see FIG. 16), and thus the movable table 52 of the cleaning tool 51 is moved.

Figure 16:
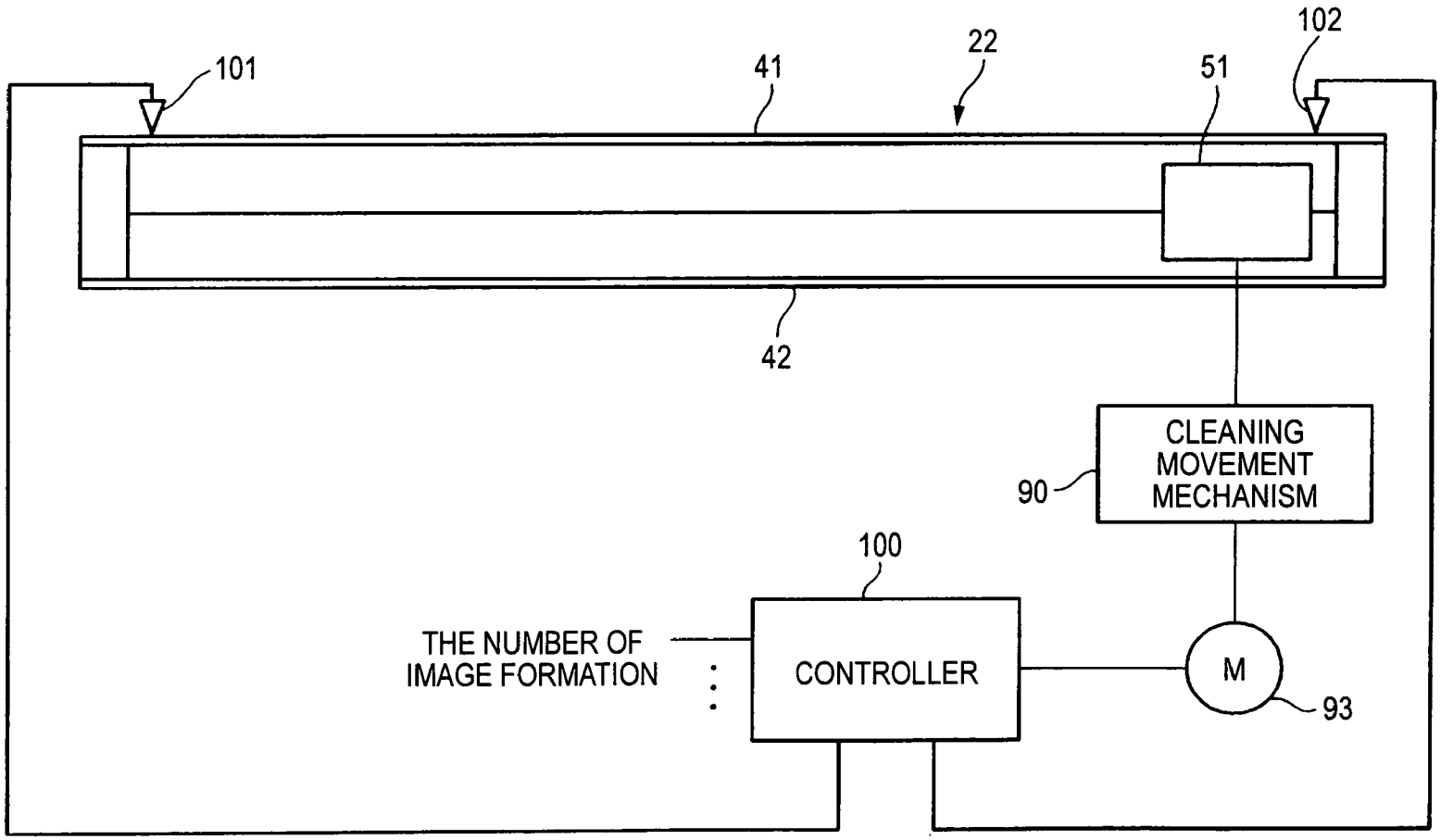
FIG. 16 is a diagram illustrating an exemplary embodiment of a control system for the cleaning device used in Embodiment 1.

As a control system for the cleaning device 50, for example, a configuration shown in FIG. 16 is employed.

In the same figure, reference numeral 100, for example, denotes a controller constituted by a microcomputer having a cleaning processing program for the cleaning device 50. Reference numerals 101 and 102 denote a position sensor for sensing that the cleaning tool 51 of the cleaning device 50 reaches the initial position and the end portion opposite to the initial position of the charging container 41, and for example, a limit switch or the like is used.

Next, an operation of the image forming apparatus according to the embodiment will be described with respect to the cleaning device for the charging device.

In the embodiment, as shown in FIG. 16, the controller 100 counts the number of image formation, executes the cleaning processing program every time when the number of image formation reaches the predetermined number, moves the cleaning tool 51 from the initial position in the going direction, moves the cleaning tool 51 in the coming direction based on a detection signal from the position sensor 102 in the step where the cleaning tool 51 reaches the position opposite to the initial position of the charging container 41, stops the cleaning tool 51 based on the detection signal from the position sensor 101 at the time when the cleaning tool 51 returns to the initial position, and thus resets the number of image formation.

The executing time of the cleaning processing program is not limited to the predetermined number of image formation, but may be appropriately selected, for example, at every cycle or in accordance with user's manipulation.

In such an operation process, the cleaning device 50 waits in the cleaning waiting room 45 of the charging container 41 at the non-cleaning time. Accordingly, the cleaning device 50 does not interfere with the charging operation of the charging device 22.

Figure 17A:
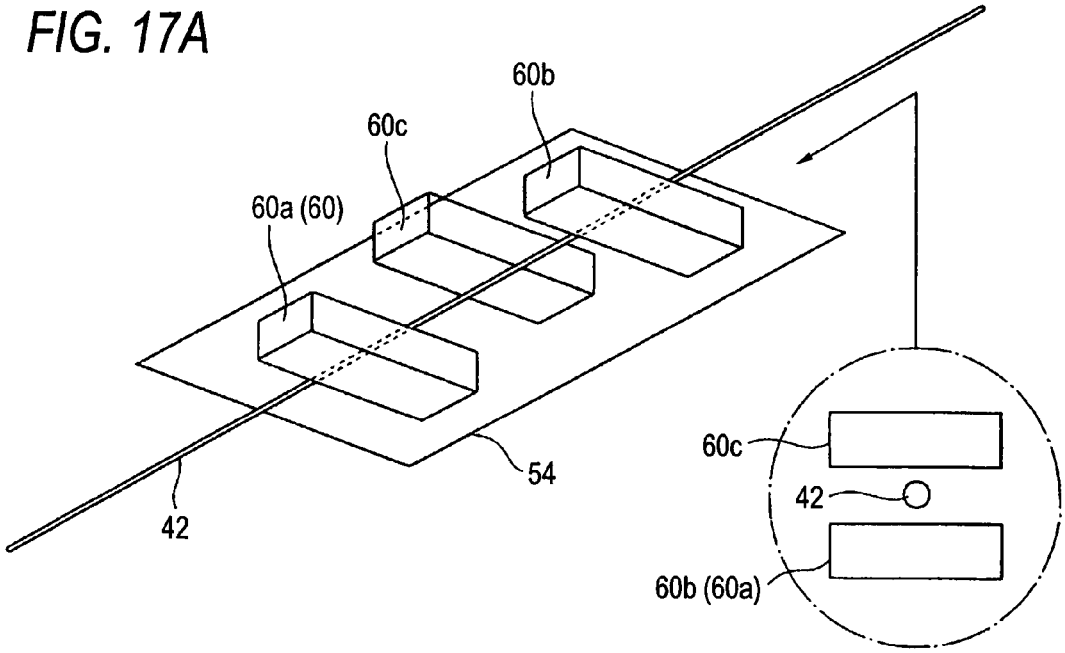
FIG. 17A is a diagram illustrating a state of the cleaning device at a non-operation time.

As shown in FIGS. 13 and 17A, since the cleaning pads 60 (60*a* to 60*c*) is not contacted with the discharge wire 42, the traces of biting of the discharge wire 42 do not remain on the cleaning pads 60.

Meanwhile, when the cleaning processing program is executed, the cleaning movement mechanism 90 moves the cleaning tool 51 from the initial position in the going direction based on the control signal from the controller 100.

Figure 17B:
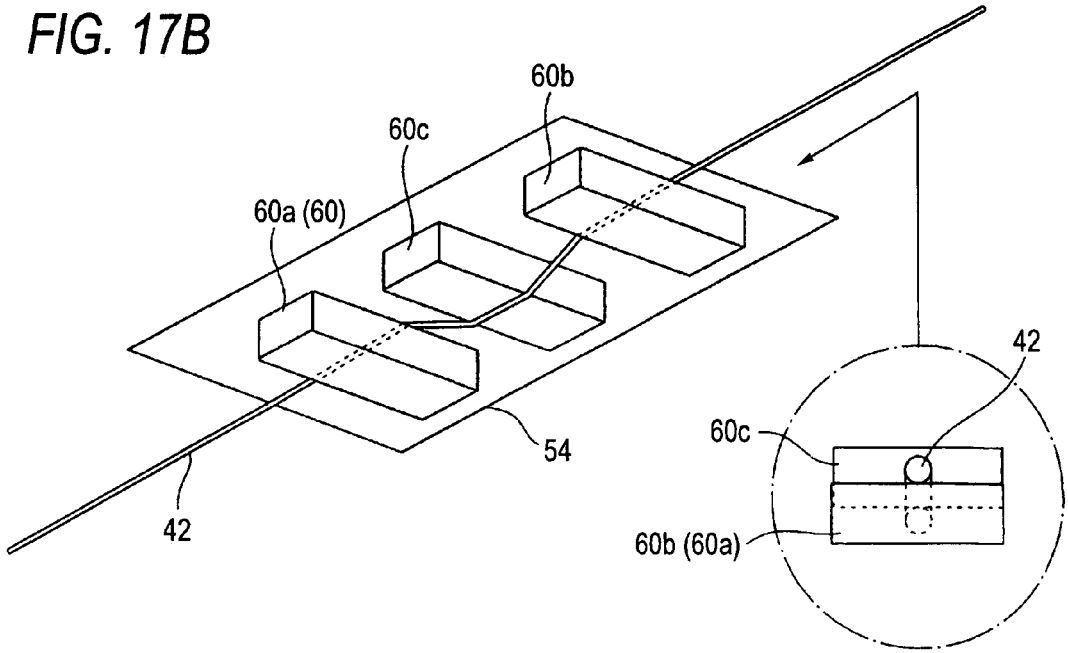
FIG. 17B is a diagram illustrating a state of the cleaning device at an operation time.

Then, as shown in FIGS. 14 and 17B, the intermediate cleaning pad 60*c* of the cleaning device 50 moves to the cleaning position. Accordingly, the side cleaning pads 60*a*, 60*b* and the intermediate cleaning pad 60*c* are contacted with the discharge wire 42 and move with the discharge wire 42 interposed therebetween.

In such a course, since the side cleaning pads 60*a* and 60*b* move so as to wipe a side of the discharge wire 42 close to the photoreceptor 21 and the intermediate cleaning pad 60*c* moves so as to wipe the opposite side thereof, the discharge products attached close to the photoreceptor 21 among the discharge products attached to the discharge wire 42 are completely cleaned. Accordingly, the cleaning performance for the discharge wire 42 is satisfactorily maintained.

Sine the discharge wire 42 is cleaned by the three cleaning pads 60 (60*a* to 60*c*), the cleaning area is wider, for example, than the cleaning area cleaned using two cleaning pads. Accordingly, the cleaning performance of the cleaning tool 51 is improved as much.

For example, in a case where the biting distance of the intermediate cleaning pad 60*c* is set to be small, the wiping performance of the cleaning pads 60 comes down. However, since the cleaning area of the cleaning tool 51 expands, it is easy to set the cleaning ability of the cleaning tool 51 to be in an appropriate extent by adjusting both of the performance and the area.

In the embodiment, when the cleaning tool 51 reaches the end portion opposite to the initial position of the charging container 41, the cleaning movement mechanism 90 moves the cleaning tool 51 in the coming direction based on the control signal from the controller 100 and the discharge wire 42 is cleaned.

As described with reference to FIGS. 2 and 3, since the cleaning powers of the cleaning tool 51 in going direction and coming direction are substantially equal to each other, the cleaning power of the cleaning tool 51 uniformly acts irrespective of the movement direction of the cleaning tool 51.

In the embodiment, the support frame 53 is provided with the cleaning reception member 54. Accordingly, even when the discharge products wiped from discharge wire 42 by the cleaning pad 60 drop down, the discharge products are received on the cleaning reception member 54. Therefore, the dropping of the charging products onto the lattice-shaped electrode 43 or the photoreceptor 21 does not have a bad influence on the charging performance of the charging device 22 or the formation of the latent image on the photoreceptor 21.

In the embodiment, when the cleaning tool 51 reaches the end portion opposite to the initial position of the charging container 41, the movement direction of the cleaning tool 51 is changed to the coming direction in the state where the cleaning pads 60 (60*a* to 60*c*) are separated from the discharge wire 42, and then the cleaning pads 60 is disposed so as to be contacted with the discharge wire 42 again.

For the reason, in the embodiment, the discharge wire 42 does not partially infiltrate into the cleaning pads 60 when the movement direction of the cleaning tool 51 is changed from the going direction to the coming direction. Consequently, the life of the cleaning pads 60 extends as much.

Example 1

When the cleaning device 50 for the charging device 22 used in the embodiment is considered as Example 1 and the cleaning tool 51 is moved in the going and coming directions, the wire tension is measured. The result shown in FIG. 18 is obtained.

Figure 18:
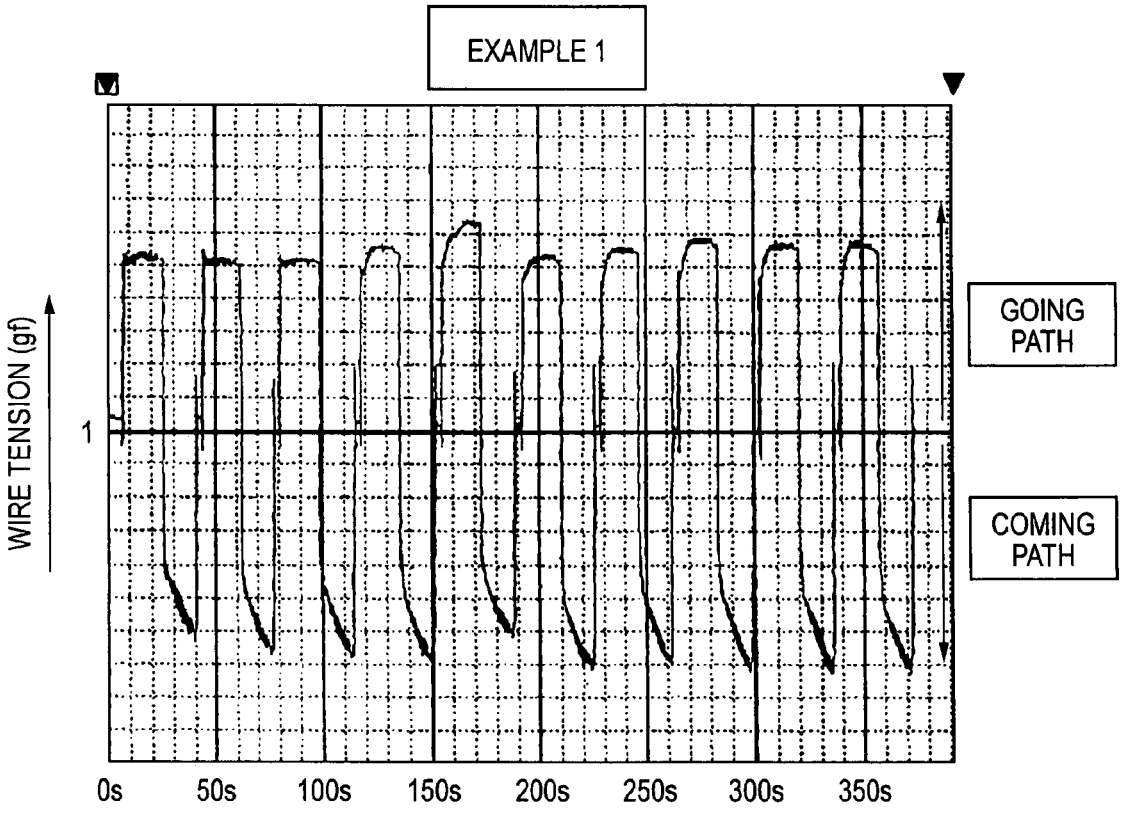
FIG. 18 is a diagram illustrating a change in wire tension in going and coming paths in case of using a cleaning device according to Example 1.

The condition in FIG. 18 is as follows:

Discharge Wire:

Material: tungsten wire

Wire Diameter: 40 μm

Cleaning Pad (see FIG. 12A):

Width w: 4 mm

Thickness h: 1 mm

Distance d: 2 mm

Biting distance k: 1 mm

Movement Speed in going and coming directions: 21.5 mm/sec.

In Comparative Example 1, the cleaning pad 60*b* in Example 1 is detached and two cleaning pads 60*a* and 60*c* (the same configuration as Example 1) is used to conduct a test under the condition described as follows. The result shown in FIG. 19 is obtained.

Figure 19:
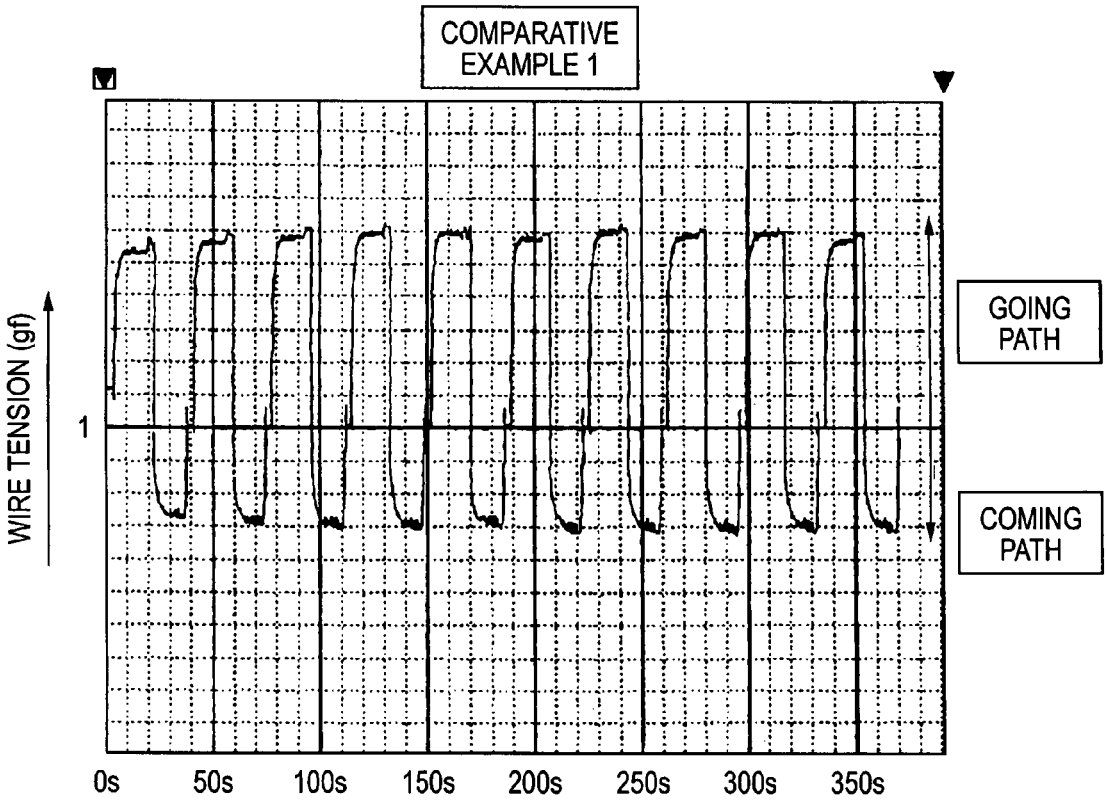
FIG. 19 is a diagram illustrating a change in wire tension in going and coming paths in case of using a cleaning device according to Comparative Example 1.

The condition in FIG. 19 is as follows:

Discharge Wire:

Material: tungsten wire

Wire Diameter: 40 μm

Width w: 4 mm

Thickness h: 1 mm

Distance d: 1 mm

Biting distance k: 1.6 mm

Movement Speed in going and coming directions: 21.5 mm/sec.

In Example, it can be appreciated from FIG. 18 that the wire tension is substantially uniform irrespective of the movement direction of the cleaning tool 51.

On the contrary, according to FIG. 19, in Comparative Example 1, the wire tension is changed depending on the movement direction of the cleaning tool. In particular, the wire tension in the coming direction becomes smaller than the wire tension in the going direction. Therefore, the cleaning power of the cleaning tool may be insufficient as much.

Example 2

When the cleaning device 50 for the charging device 22 used in the embodiment is considered as Example 2 and the relation between biting distance/pad distance (k/d) and the wire tension is examined. The condition in Example 2 is the same as that in Example 1. Comparative Example 2 having the same configuration as Comparative Example 2 is used to conduct the same test as that in Example 2.

Figure 20:
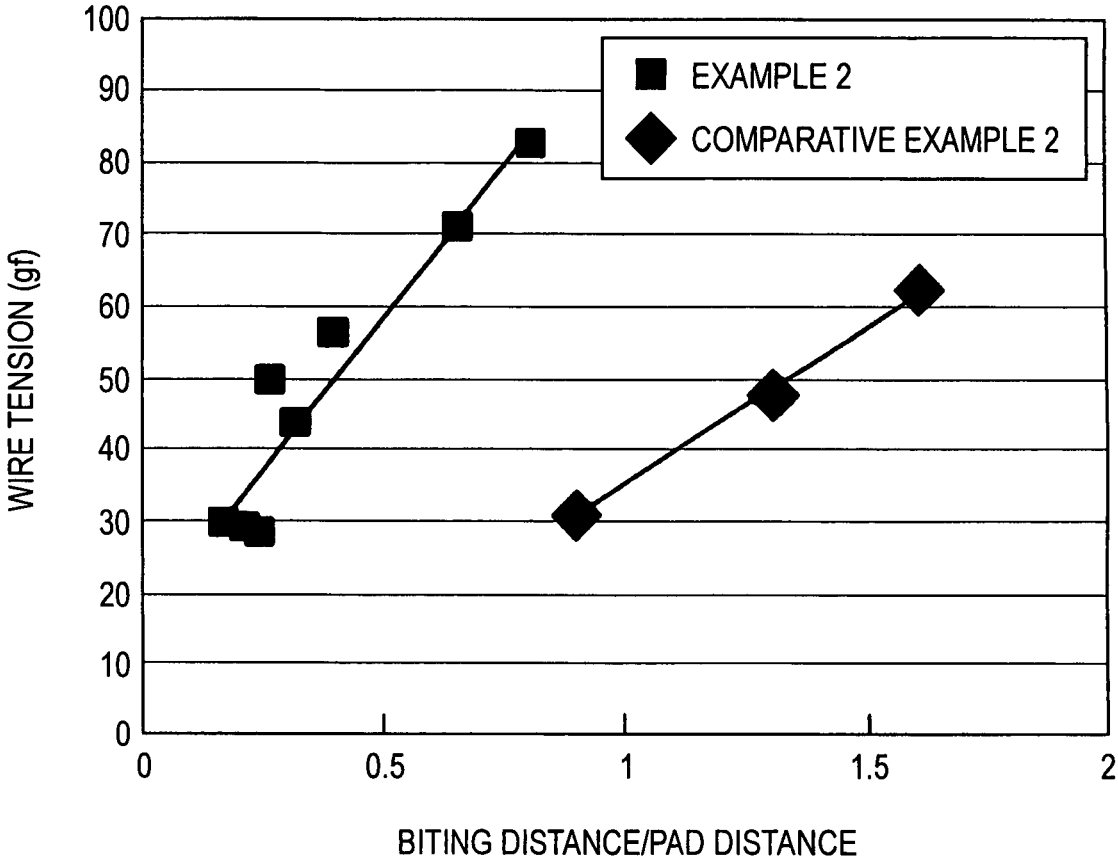
FIG. 20 is a diagram illustrating a relation between a biting distance/pad distance and a wire tension in Example 2 and Comparative Example 2.

The result is shown in FIG. 20.

In Example 2, it is confirmed from the same figure that the wire tension is in the range of about 30 to about 80 gf (about 0.29 to about 0.78 N) when k/d is in the range of about 0.2 to about 0.7 and the cleaning performance of the cleaning tool 51 is satisfactorily maintained.

The same test as Example 2 is conducted using materials other than the materials used in Example 2. As a result, the substantially same tendency as that shown in FIG. 20 can be seen.

In Comparative Example 2, when k/d is increased by 0.9 or more, the wire tension is in the range of about 30 to about 60 gf (about 0.29 to about 0.59 N). It can be seen that a design is complicated. For example, the biting distance increased to obtain the sufficient wire tension for cleaning or the distance between the cleaning pads decreased.

Example 3

When the cleaning device 50 for the charging device 22 used in the embodiment is considered as Example 3, the relation between the number (where once reciprocation counts as once) of cleaning of the cleaning tool 51 and non-uniformity in discharge (corresponding to non-uniformity in charging of the charging device 22 in the longitudinal direction) is examined.

The condition in Example 3 is substantially the same as that in Example 1. The test is conducted in the same manner as Example 3 using Comparative Example 3 having the same configuration as Comparative Example 1.

Figure 21:
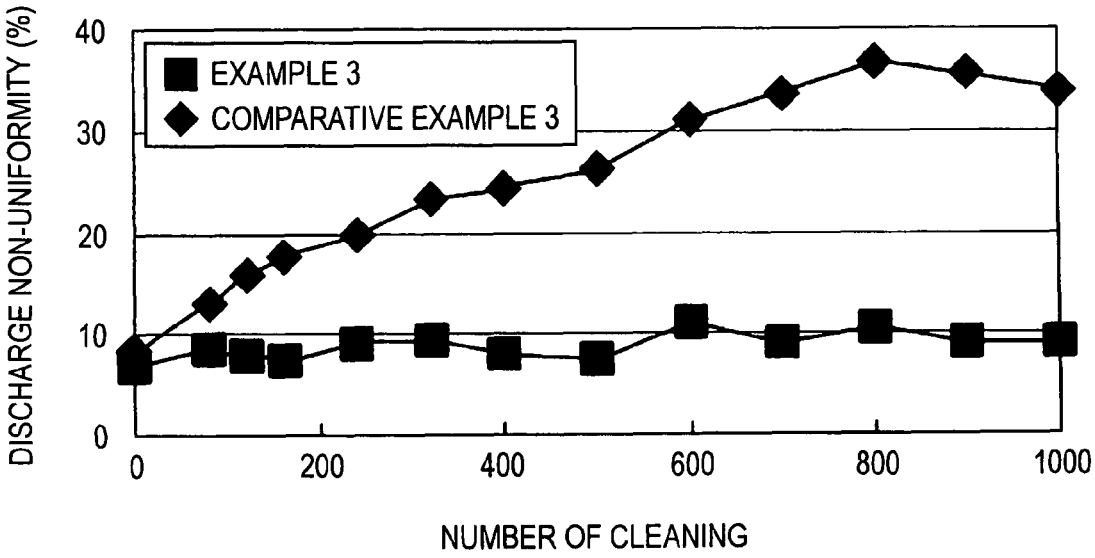
FIG. 21 is a diagram illustrating a relation between the number of cleaning and non-uniformity of discharge in Example 3 and Comparative Example 3.

The result is shown in FIG. 21.

The following tendency can be seen from the same figure: the non-uniformity in discharge is suppressed by about 10% until the number of cleaning reaches 1000 times in Example 3, but the non-uniformity in discharge is increased as soon as the number of cleaning was over 100 times.

It can be appreciated from the tendency of change in FIG. 21 that the life of the cleaning tool 51 in Example 3 is better than that in Comparative Example 3 by about 9 to 10 times.

Example 4

In Comparative Example 4 (the same as Comparative Example 1), the biting distance of the cleaning pad and the wire tension are examined. The result shown in FIG. 22 is obtained.

In Comparative Example 4, the biting distance of the cleaning pad and the non-uniformity in discharge current are examined. The result shown in FIG. 23 is obtained.

Figure 22:
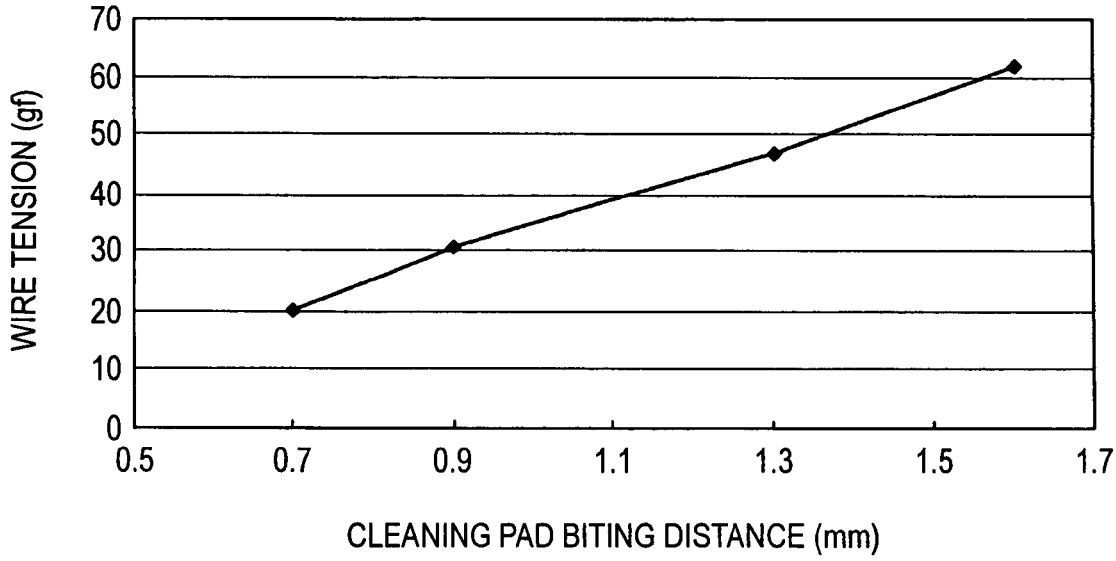
FIG. 22 is a diagram illustrating a relation between a biting distance of a cleaning pad and a wire tension in Comparative Example 4.
Figure 23:
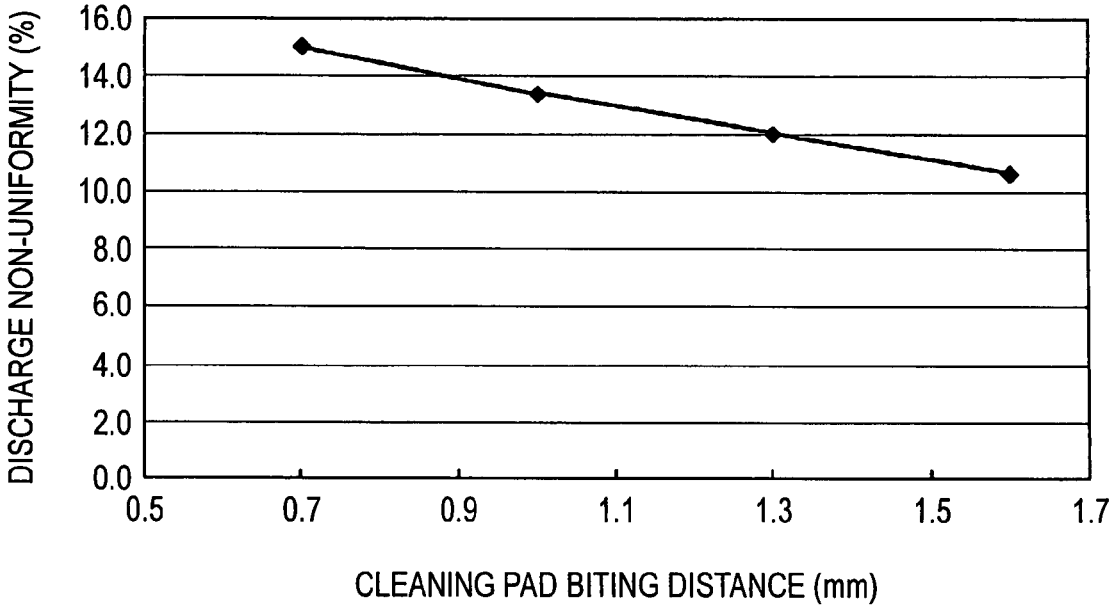
FIG. 23 is a diagram illustrating a relation between a biting distance of a cleaning pad and non-uniformity of a discharge current in Comparative Example 4.
Figure 24:
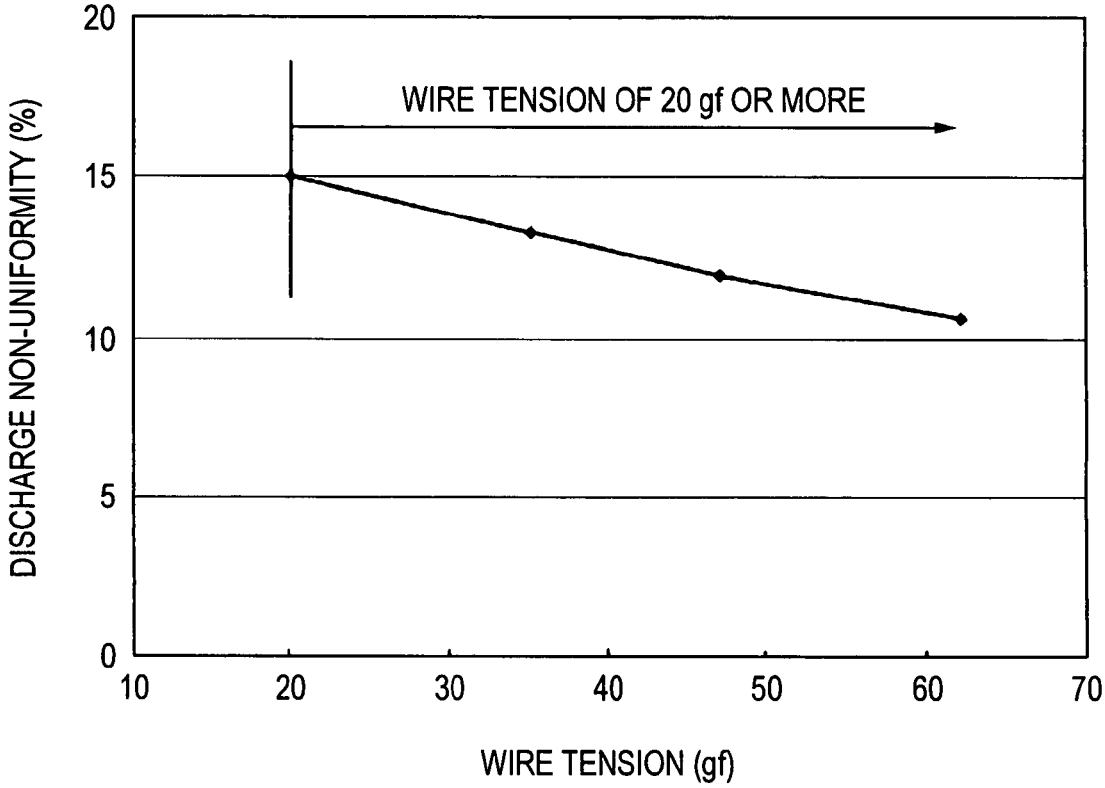
FIG. 24 is a diagram illustrating a relation between a wire tension and non-uniformity of a discharge current in Comparative Example 4.

In Comparative Example 4, the relation between the wire tension and the non-uniformity in discharge current is examined with respect to FIGS. 22 and 23. The result shown in FIG. 24 is obtained.

It can be appreciated from the results that the wire tension of 20 gf is required in Comparative Example 4 in order to suppress the non-uniformity in discharge current by 15% or less.

Therefore, it can be appreciated that the wire tension of 20 gf is required even in Example 4 (substantially the same as Example 1).

Example 5

In Comparative Example 5 (substantially the same as Comparative Example 1), the diameter of the discharge wire is set to 30 μm and 40 μm to change the biting distance of the cleaning pad. The number of cleaning of the cleaning pad is examined with respect to tear of the cleaning pad. The result shown in FIG. 25 is obtained.

In Comparative Example 5, the following facts can be appreciated from FIG. 25. When the wire diameter is 40 μm and the biting distance is 1.6 mm, the cleaning pad is not torn until the number of cleaning is about 420 times. However, when the wire diameter becomes thinner by 30 μm and the biting distance of the cleaning pad is 1.6 mm, the cleaning pad is torn at the time when the number of cleaning id about 90 times.

In Comparative Example 5, the following fact can be appreciated. When the wire diameter is 40 μm and the biting distance was 1.3 mm or less, the number of cleaning could be kept 1000 times. However, when the wire diameter is 30 μm and the biting distance is not 1.0 mm or less, the number of cleaning could not be kept 1000 times or more.

Accordingly, in Example 5 (substantially the same as Example 1), it is possible to set the diameter of the discharge wire 42 to be thin by 30 μm and to set the biting distance of the cleaning pad to be 1.0 mm or less. Consequently, in the embodiment, it can be appreciated that the cleaning performance of the cleaning tool 51 is satisfactorily maintained.

What is claimed is:

1. A cleaning device comprising:

three or more cleaning members for cleaning a wire member, the three or more cleaning members being separately disposed along a longitudinal direction of the wire member and including a pair of side cleaning members and an intermediate cleaning member, the intermediate cleaning member being disposed opposite to the pair of side cleaning members with respect to the wire member and disposed between the side cleaning members in the longitudinal direction of the wire member;

a first mechanism that moves at least one of the cleaning members so as to contact all of the cleaning members with the wire member or separate all of the cleaning members from the wire member; and a second mechanism that moves all of the cleaning members along the longitudinal direction of the wire member in a state where all of the cleaning members are contacted with the wire member.

2. The cleaning device according to claim 1, wherein at least one of the side cleaning members and the intermediate cleaning member comprises an elastic member having a non-woven fabric on a surface of the elastic member, the non-woven having an abrasive on a surface of the non-woven.

3. The cleaning device according to claim 1, wherein the side cleaning members and the intermediate cleaning member have a configuration common to each other.

4. The cleaning device according to claim 1, wherein the intermediate cleaning member is disposed in the center between the side cleaning members in the longitudinal direction of the wire member.

5. The cleaning device according to claim 1, wherein the first mechanism holds the intermediate cleaning member movably in a direction perpendicular to the longitudinal direction of the wire member and moves the intermediate cleaning member so as to contact all of the cleaning members with the wire member or separate all of the cleaning members from the wire member.

6. The cleaning device according to claim 5, wherein the first mechanism moves the intermediate cleaning member so as to adjust oblique angles of portions of the wire member, which is located between the intermediate cleaning member and the side cleaning members, with respect to the cleaning members.

7. The cleaning device according to claim 5, further comprising a support member that supports the cleaning members, wherein the first mechanism is provided so that the side cleaning members are fixedly attached to the support member, the intermediate cleaning member is movably attached, and the wire member is bent to contact the side cleaning members with the wire member when the intermediate cleaning member is contacted with the wire member.

8. The cleaning device according to claim 1, wherein the first mechanism is provided so that k/d is in the range of about 0.2 to about 0.7, wherein d denotes a distance between the intermediate cleaning member and the side cleaning members in the longitudinal direction of the wire member and k denotes a biting distance corresponding to a relative difference between a position of the side cleaning members contacted with the wire member and a position of the intermediate contacted with the wire member.

9. The cleaning device according to claim 1, wherein the second mechanism reciprocates along the longitudinal direction of the wire member in a state where all of the cleaning members are contacted with the wire member.

10. A charging device comprising:

a charging container having an opening opposed to a charging target;

a charging wire member disposed in the charging container; and a cleaning device for cleaning the charging wire member, the cleaning device comprising:

three or more cleaning members for cleaning the charging wire member, the three or more cleaning members being separately disposed along a longitudinal direction of the charging wire member and including a pair of side cleaning members and an intermediate cleaning member, the intermediate cleaning member being disposed opposite to the pair of side cleaning members with respect to the charging wire member and disposed between the side cleaning members in the longitudinal direction of the charging wire member;

a first mechanism that moves at least one of the cleaning members so as to contact all of the cleaning members with the charging wire member or separate all of the cleaning members from the charging wire member; and a second mechanism that moves all of the cleaning members along the longitudinal direction of the charging wire member in a state where all of the cleaning members are contacted with the charging wire member.

11. The charging device according to claim 10, further comprising a lattice-shaped electrode in the opening of the charging container.

12. The charging device according to claim 10, wherein at least one of the side cleaning members and the intermediate cleaning member is disposed so as to clean a surface of the charging wire member opposed to the charging target.

13. The charging device according to claim 10, which is disposed above the charging target, wherein the second mechanism includes a cleaning reception member below the side cleaning members and the intermediate cleaning member, the cleaning reception member moving together with all of the cleaning members.

14. The charging device according to claim 10, wherein the second mechanism has a room where the cleaning device waits at a non-cleaning time, the room being in the vicinity of an end portion of the charging wire member in the longitudinal direction of the charging wire member and being deviated from a charging area of the charging container, the second mechanism moving the cleaning device from the room at a cleaning time.

15. An image holding unit comprising:

an image holding member that holds an image visualized from a latent image by an image forming material; and a charging device that charges the image holding member, the image holding unit being detachably provided in an image forming apparatus body, the charging device comprising:

a charging container having an opening opposed to a charging target;

a charging wire member disposed in the charging container; and a cleaning device for cleaning the charging wire member, the cleaning device comprising:

three or more cleaning members for cleaning the charging wire member, the three or more cleaning members being separately disposed along a longitudinal direction of the charging wire member and including a pair of side cleaning members and an intermediate cleaning member, the intermediate cleaning member being disposed opposite to the pair of side cleaning members with respect to the charging wire member and disposed between the side cleaning members in the longitudinal direction of the charging wire member;

a first mechanism that moves at least one of the cleaning members so as to contact all of the cleaning members with the charging wire member or separate all of the cleaning members from the charging wire member; and a second mechanism that moves all of the cleaning members along the longitudinal direction of the charging wire member in a state where all of the cleaning members are contacted with the charging wire member.

16. An image forming apparatus comprising:

an image holding member that holds an image visualized from a latent image by an image forming material; and a charging device that charges the image holding member, the charging device comprising:

a charging container having an opening opposed to a charging target;

a charging wire member disposed in the charging container; and a cleaning device for cleaning the charging wire member, the cleaning device comprising:

three or more cleaning members for cleaning the charging wire member, the three or more cleaning members being separately disposed along a longitudinal direction of the charging wire member and including a pair of side cleaning members and an intermediate cleaning member, the intermediate cleaning member being disposed opposite to the pair of side cleaning members with respect to the charging wire member and disposed between the side cleaning members in the longitudinal direction of the charging wire member;

a first mechanism that moves at least one of the cleaning members so as to contact all of the cleaning members with the charging wire member or separate all of the cleaning members from the charging wire member; and a second mechanism that moves all of the cleaning members along the longitudinal direction of the charging wire member in a state where all of the cleaning members are contacted with the charging wire member.

* * * * *